US012331606B2

(12) United States Patent
Blankemeyer et al.

(10) Patent No.: US 12,331,606 B2
(45) Date of Patent: Jun. 17, 2025

(54) APPARATUS INCLUDING SLIP CARTRIDGE AND ASSOCIATED METHODS FOR TUBULAR STRING

(71) Applicant: Downing Wellhead Equipment, LLC, Oklahoma City, OK (US)

(72) Inventors: Tyler Blankemeyer, Oklahoma City, OK (US); Matthew Melton, Norman, OK (US); Arturo Trejo, Houston, TX (US); Tim Marvel, Houston, TX (US)

(73) Assignee: Downing Wellhead Equipment, LLC, Oklahoma City, OK (US)

( * ) Notice: Subject to any disclaimer, the term of this patent is extended or adjusted under 35 U.S.C. 154(b) by 0 days.

(21) Appl. No.: 18/776,595

(22) Filed: Jul. 18, 2024

(65) Prior Publication Data

US 2025/0027376 A1 Jan. 23, 2025

Related U.S. Application Data

(60) Provisional application No. 63/514,255, filed on Jul. 18, 2023.

(51) Int. Cl.
*E21B 23/03* (2006.01)
*E21B 33/068* (2006.01)

(52) U.S. Cl.
CPC ..... *E21B 23/03* (2013.01); *E21B 33/068* (2013.01)

(58) Field of Classification Search
CPC ..... E21B 33/04; E21B 23/03; E21B 33/068
See application file for complete search history.

(56) References Cited

U.S. PATENT DOCUMENTS

| | | | |
|---|---|---|---|
| 2,525,391 | A | 10/1950 | Bates |
| 5,253,710 | A | 10/1993 | Carter et al. |
| 5,381,631 | A | 1/1995 | Raghavan et al. |
| 5,996,695 | A | 12/1999 | Koleilat et al. |
| 6,065,542 | A | 5/2000 | Lalor et al. |
| 6,095,242 | A | 8/2000 | Lequang et al. |
| 6,138,774 | A | 10/2000 | Bourgoyne, Jr. et al. |
| 6,805,200 | B2 | 10/2004 | DeBerry |
| 7,134,490 | B2 | 11/2006 | Nguyen |
| 8,196,649 | B2 | 6/2012 | Allen et al. |
| 8,261,837 | B2 | 9/2012 | Leonard et al. |
| 8,424,607 | B2 | 4/2013 | Springett et al. |
| 8,479,824 | B2 | 7/2013 | Travis et al. |
| 8,511,393 | B2 | 8/2013 | Nguyen |
| 8,668,020 | B2 | 3/2014 | Guitierrez et al. |
| 8,960,276 | B2 | 2/2015 | Lang et al. |
| 9,038,712 | B1 | 5/2015 | Streety et al. |
| 9,085,950 | B2 | 7/2015 | Spacek |
| RE46,241 | E | 12/2016 | Cain et al. |
| 9,534,465 | B2 | 1/2017 | Nguyen et al. |
| 9,702,211 | B2 | 7/2017 | Tinnen |
| 9,745,816 | B2 | 8/2017 | Milne et al. |

(Continued)

*Primary Examiner* — Dany E Akakpo
(74) *Attorney, Agent, or Firm* — HAYNES AND BOONE, LLP

(57) ABSTRACT

Apparatus and methods according to which a slip cartridge is secured to a first segment of a tubular string, the slip cartridge is landed in a wellhead by conveying the tubular string to which the slip cartridge is secured through the wellhead and into a wellbore, the slip cartridge is left behind landed in the wellhead, and the slip cartridge is set in the wellhead by securing a plurality of slips of the slip cartridge to a second segment of the tubular string.

28 Claims, 28 Drawing Sheets

(56) References Cited

U.S. PATENT DOCUMENTS

| | | | | |
|---|---|---|---|---|
| 9,926,758 | B1 | 3/2018 | Adkins et al. | |
| 10,900,310 | B2 | 1/2021 | Melton et al. | |
| 2002/0117308 | A1* | 8/2002 | Dallas | E21B 19/00 166/382 |
| 2012/0013893 | A1 | 1/2012 | Maida et al. | |
| 2013/0213636 | A1 | 8/2013 | McAfee et al. | |
| 2014/0090846 | A1 | 4/2014 | Deutch et al. | |
| 2014/0231087 | A1 | 8/2014 | Orstad | |
| 2014/0251616 | A1 | 9/2014 | O'Rourke et al. | |
| 2016/0215580 | A1 | 7/2016 | Lehr | |
| 2017/0101840 | A1 | 4/2017 | Kauffmann et al. | |
| 2018/0112479 | A1* | 4/2018 | Nguyen | E21B 23/01 |
| 2018/0245450 | A1 | 8/2018 | Stokes et al. | |
| 2018/0313156 | A1 | 11/2018 | Steele et al. | |

* cited by examiner

APPARATUS INCLUDING SLIP CARTRIDGE AND ASSOCIATED METHODS FOR TUBULAR STRING

CROSS-REFERENCE TO RELATED APPLICATIONS

This application claims the benefit of the filing date of, and priority to, U.S. Patent Application No. 63/514,255 (the "'255 Application"), filed Jul. 18, 2023, the entire disclosure of which is hereby incorporated herein by reference.

This application is also related to U.S. patent application Ser. No. 16/129,597, filed Sep. 12, 2018, now issued as U.S. Pat. No. 10,900,310 (the "'310 Patent"), the entire disclosure of which is hereby incorporated herein by reference.

TECHNICAL FIELD

The present disclosure relates generally to hangers for tubular strings used in oil and gas operations, and, more particularly, to apparatus including a slip cartridge and associated methods for a tubular string.

BRIEF DESCRIPTION OF THE DRAWINGS

FIG. 12A-2 is an enlarged cross-sectional view of the slip cartridge installed on the tubular string of FIG. 12A-1 according to one or more embodiments of the present disclosure.

FIG. 12A-3 is another enlarged cross-sectional view of the slip cartridge installed on the tubular string of FIG. 12A-1 according to one or more embodiments of the present disclosure.

FIG. 12B-1 is a cross-sectional view of the slip cartridge landed in the casing head of FIG. 11 using the tubular string of FIG. 12A-1 according to one or more embodiments of the present disclosure.

FIG. 12B-2 is an enlarged cross-sectional view of the landed slip cartridge of FIG. 12B-1 according to one or more embodiments of the present disclosure.

FIG. 12B-3 is another enlarged cross-sectional view of the landed slip cartridge of FIG. 12B-1 according to one or more embodiments of the present disclosure.

FIG. 12C-1 is a cross-sectional view of the slip cartridge locked in the casing head of FIG. 11 using the tubular string of FIG. 12A-1 according to one or more embodiments of the present disclosure.

FIG. 12C-2 is an enlarged cross-sectional view of the locked slip cartridge of FIG. 12C-1 according to one or more embodiments of the present disclosure.

FIG. 12C-3 is another enlarged cross-sectional view of the locked slip cartridge of FIG. 12C-1 according to one or more embodiments of the present disclosure.

FIG. 12D-1 is a cross-sectional view of the slip cartridge in the casing head of FIG. 11 with the plurality of slips set onto the tubular string of FIG. 12A-1 according to one or more embodiments of the present disclosure.

FIG. 12D-2 is an enlarged cross-sectional view of the slip cartridge with the set plurality of slips of FIG. 12D-1 according to one or more embodiments of the present disclosure.

DETAILED DESCRIPTION

Figure 1A:
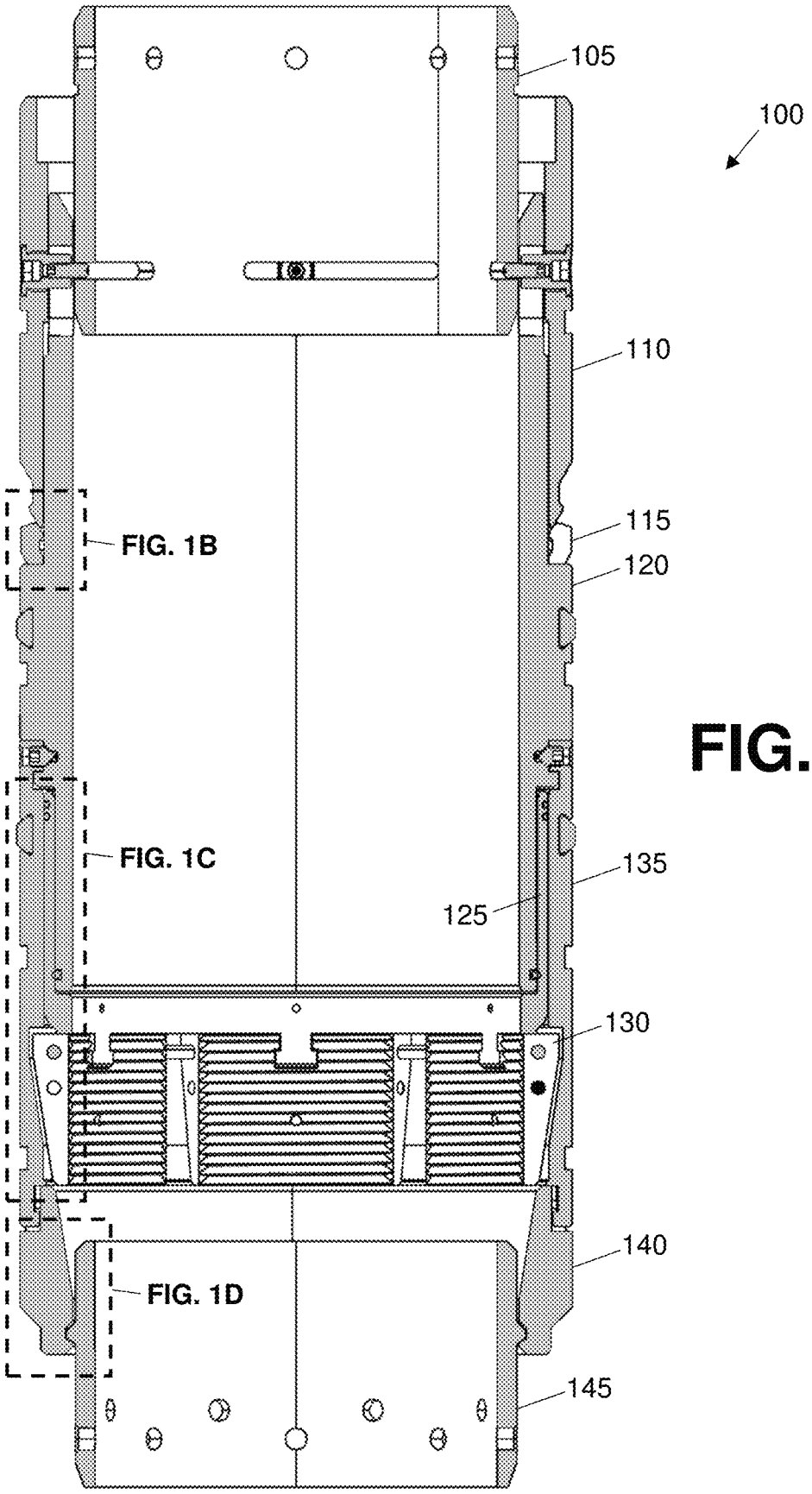
FIG. 1A is a cross-sectional view of a slip cartridge according to one or more embodiments of the present disclosure.
Figure 1B:
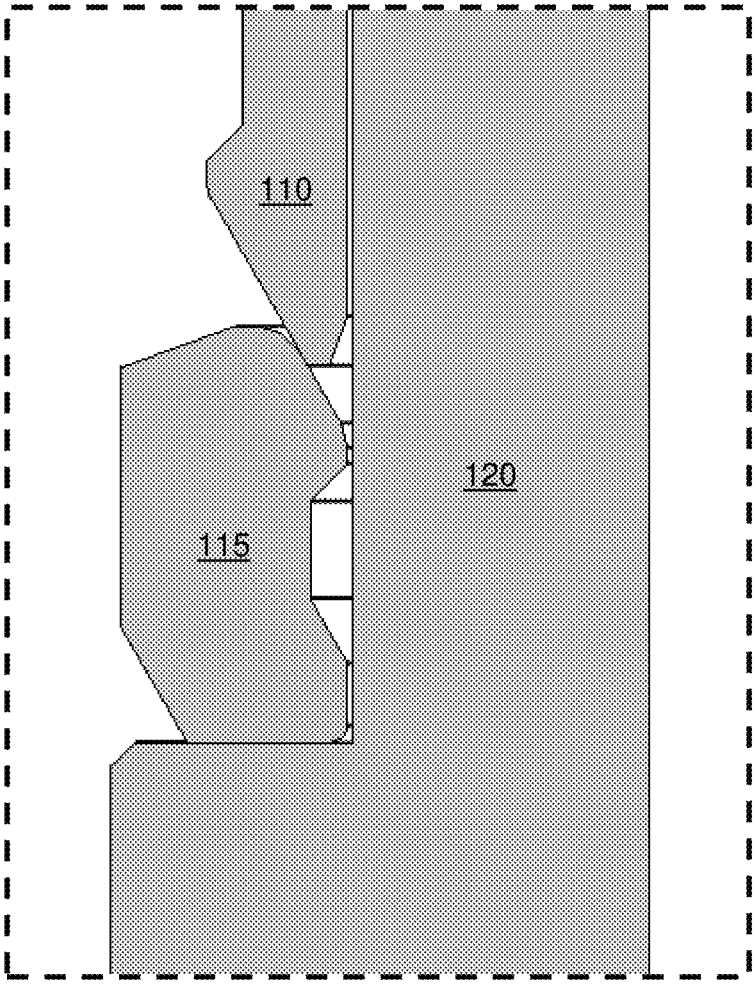
FIG. 1B is an enlarged cross-sectional view of the slip cartridge of FIG. 1A according to one or more embodiments of the present disclosure.
Figure 1C:
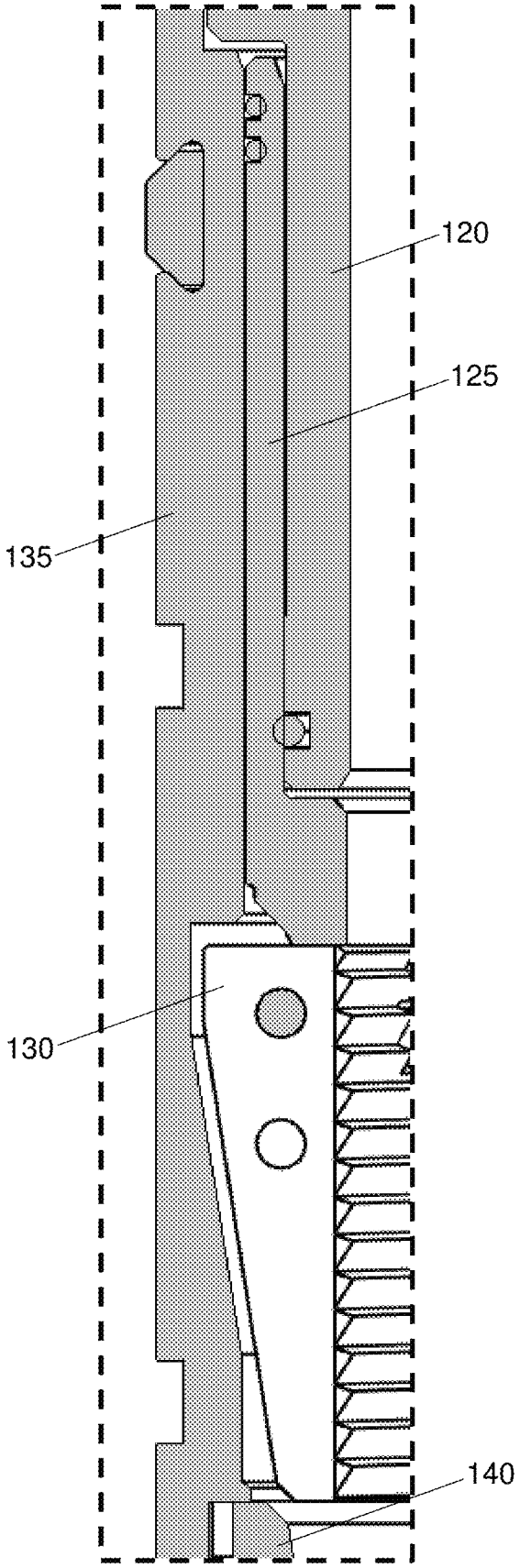
FIG. 1C is another enlarged cross-sectional view of the slip cartridge of FIG. 1A according to one or more embodiments of the present disclosure.
Figure 1D:
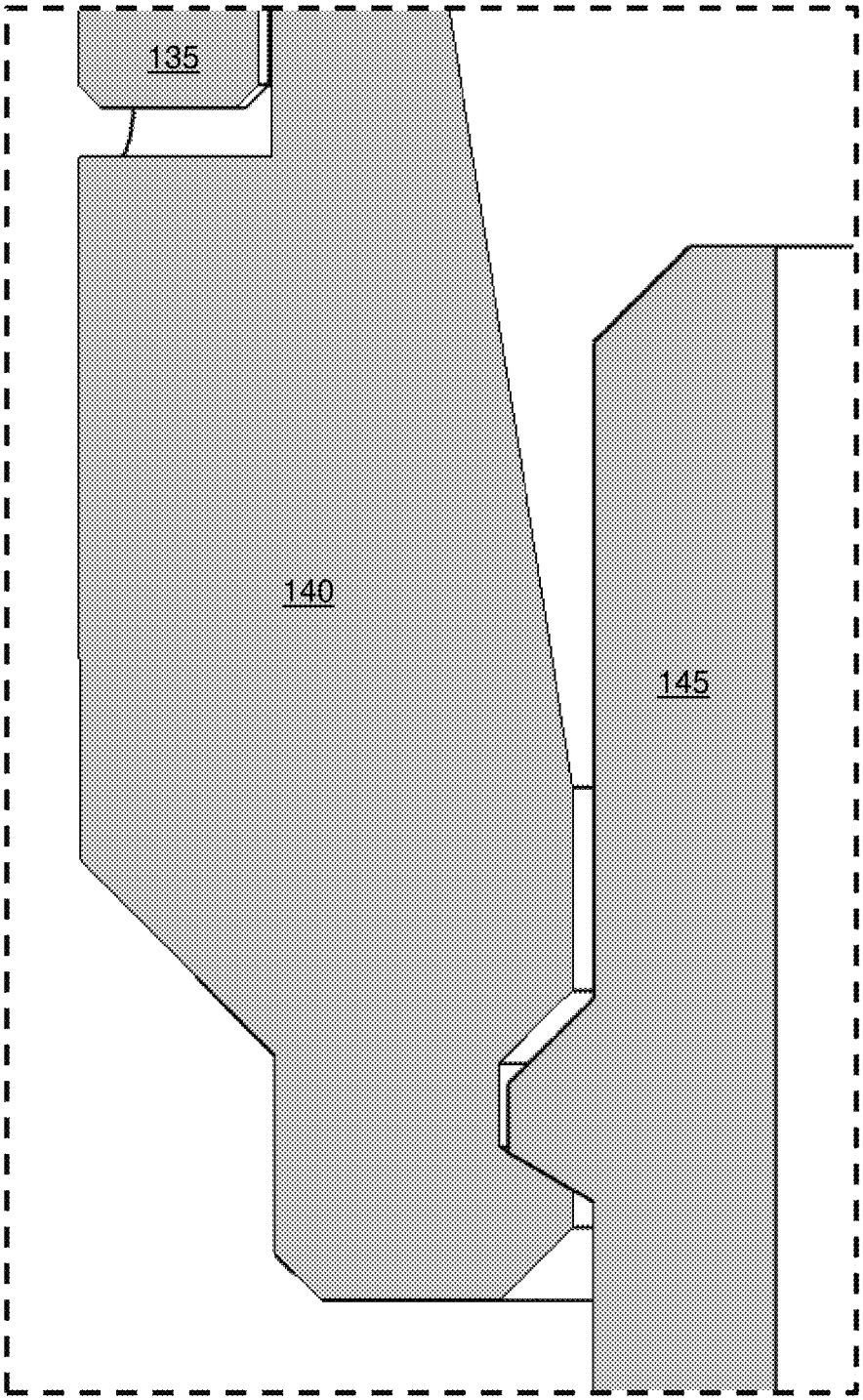
FIG. 1D is yet another enlarged cross-sectional view of the slip cartridge of FIG. 1A according to one or more embodiments of the present disclosure.

Referring to FIGS. 1A through 1D, a slip cartridge 100 is illustrated in a first operational state or configuration according to one in one or more embodiments. The slip cartridge 100 includes a locking collar 105, a locking sleeve 110, a locking ring 115, an upper body 120, a setting ring 125, a plurality of slips 130, a lower body 135, a slip bowl 140, and a running collar 145. In the first operational state or configuration: the locking sleeve 110 is axially positioned relative to the upper body 120 and the locking ring 115 so that the locking ring 115 remains unexpanded, as shown in FIG. 1B; the setting ring 125 is axially positioned relative to the slip bowl 140 so that the plurality of slips 130 are and/or remain unset, as shown in FIG. 1C; and the running collar 145 engages the slip bowl 140 to prevent, or at least reduce, axial movement of the running collar 145 relative to the slip bowl 140, as shown in FIG. 1D. In one or more embodiments, the slip 100 cartridge is adapted to be sequentially landed, locked, and set in a casing head, as will be described in further detail below. In one or more embodiments, the slip cartridge 100 includes the running collar 145. In one or more embodiments, the slip cartridge 100 is detachably coupled to the running collar 145. In one or more embodiments, the slip cartridge 100 includes the running collar 145 at least when the slip cartridge 100 is detachably coupled to the running collar 145.

Figure 2:
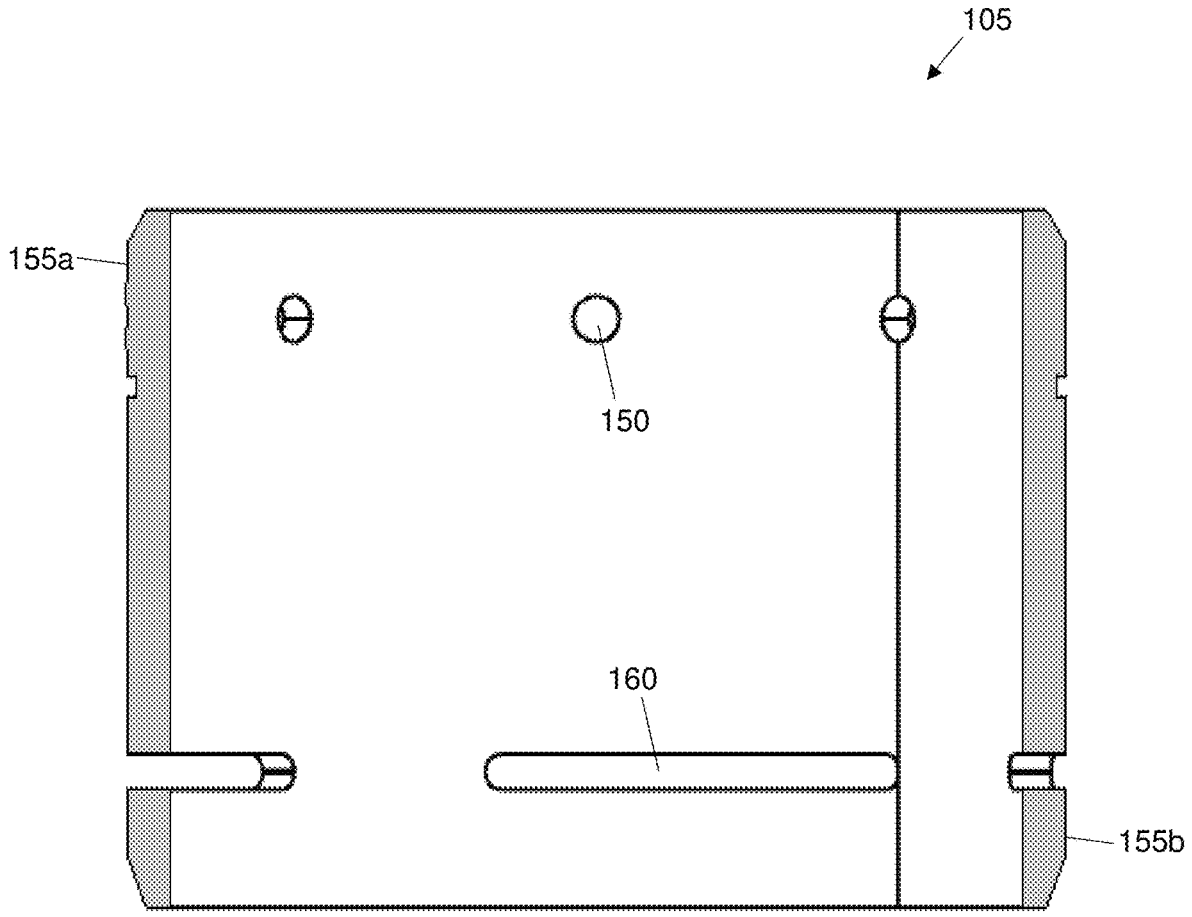
FIG. 2 is a cross-sectional view of a locking collar of the slip cartridge of FIG. 1A according to one or more embodiments of the present disclosure.

Referring to FIG. 2, the locking collar 105 of the slip cartridge 100 shown in FIG. 1A is illustrated according to one or more embodiments. The locking collar 105 is a tubular member having a plurality of openings 150 formed radially therethrough, and distributed circumferentially thereabout, proximate an end portion 155*a* thereof. A plurality of slots 160 (e.g., circumferentially-extending slots) are also formed radially through, and distributed circumferentially about, the locking collar 105, proximate another end portion 155*b* thereof (i.e., opposite the plurality of openings 150).

Figure 3:
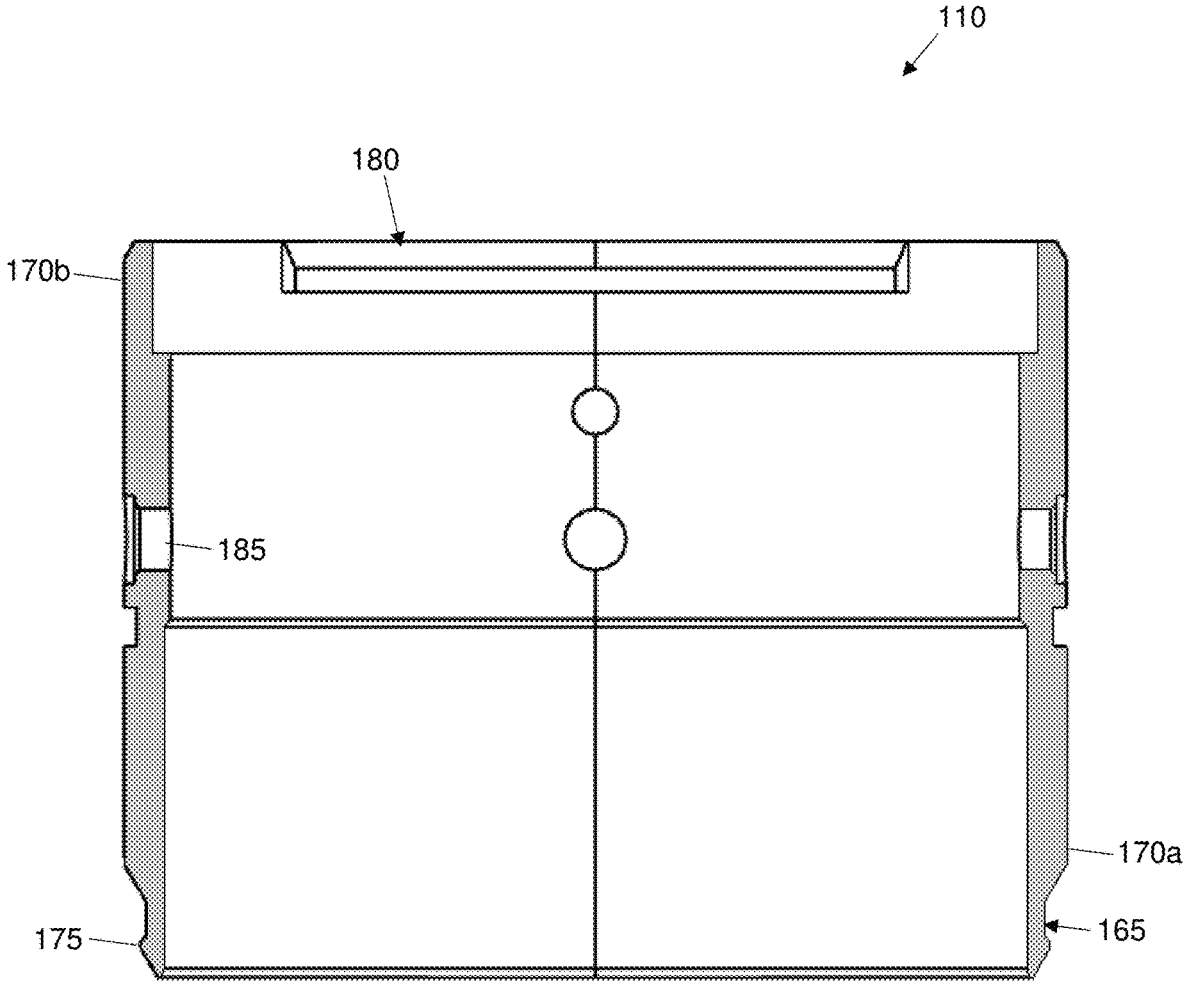
FIG. 3 is a cross-sectional view of a locking sleeve of the slip cartridge of FIG. 1A according to one or more embodiments of the present disclosure.

Referring to FIG. 3, the locking sleeve 110 of the slip cartridge 100 shown in FIG. 1A is illustrated according to one or more embodiments. The locking sleeve 110 is a tubular member defining an expansion collar 165 proximate an end portion 170*a* thereof, which expansion collar 165 defines an external ridge 175 (e.g., an annular ridge). One or more latching components 180 (e.g., internal latching component(s)) are defined at another end portion 170*b* of the locking sleeve 110 (i.e., opposite the expansion collar 165). Axially between the expansion collar 165 and the one or more latching components 180, a plurality of openings 185 are formed radially through, and distributed circumferentially about, the locking sleeve 110.

Figure 4:
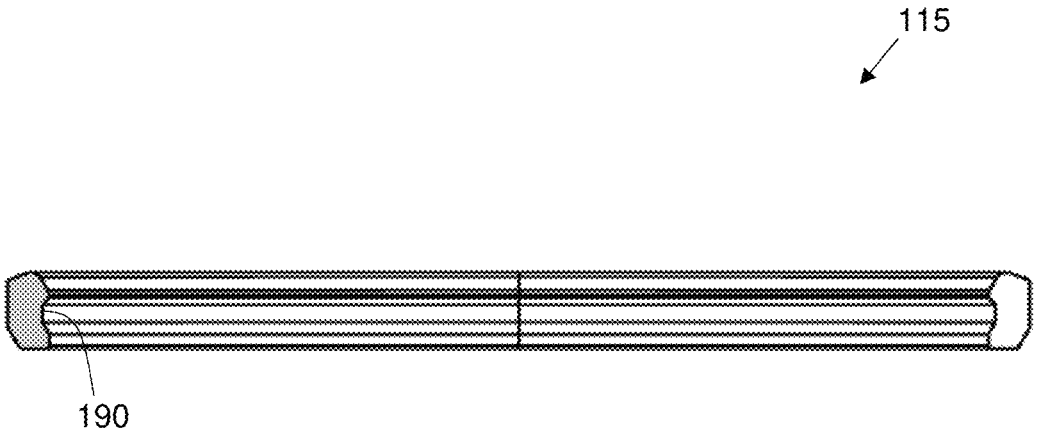
FIG. 4 is a cross-sectional view of a locking ring of the slip cartridge of FIG. 1A according to one or more embodiments of the present disclosure.

Referring to FIG. 4, the locking ring 115 of the slip cartridge 100 shown in FIG. 1A is illustrated according to one or more embodiments. The locking ring 115 is a tubular member defining an internal recess 190 (e.g., an annular recess), and is expandable to receive the external ridge 175 defined by the expansion collar 165 of the locking sleeve 110 into the internal recess 190.

Figure 5A:
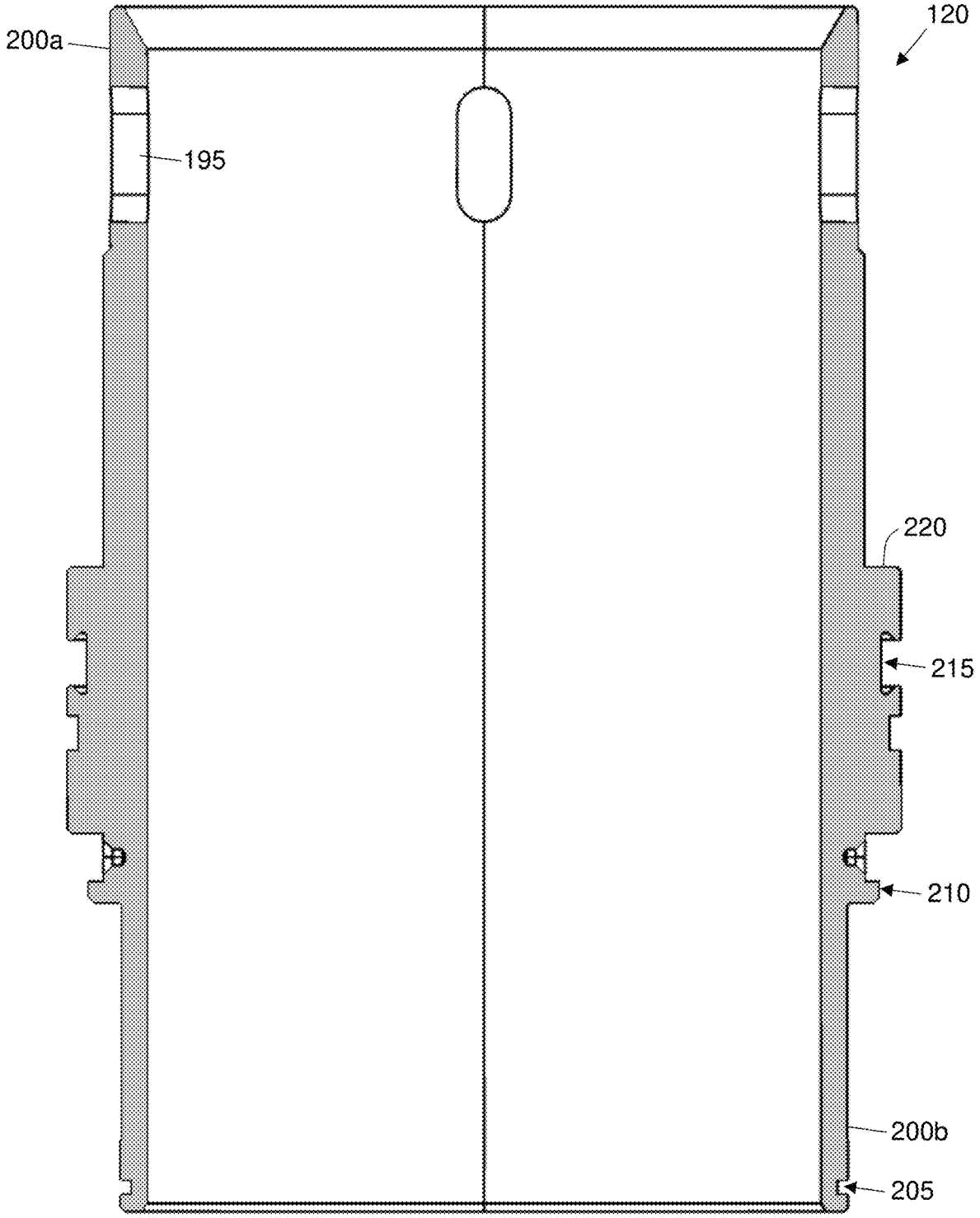
FIG. 5A is a cross-sectional view of an upper body of the slip cartridge of FIG. 1A according to one or more embodiments of the present disclosure.
Figure 5B:
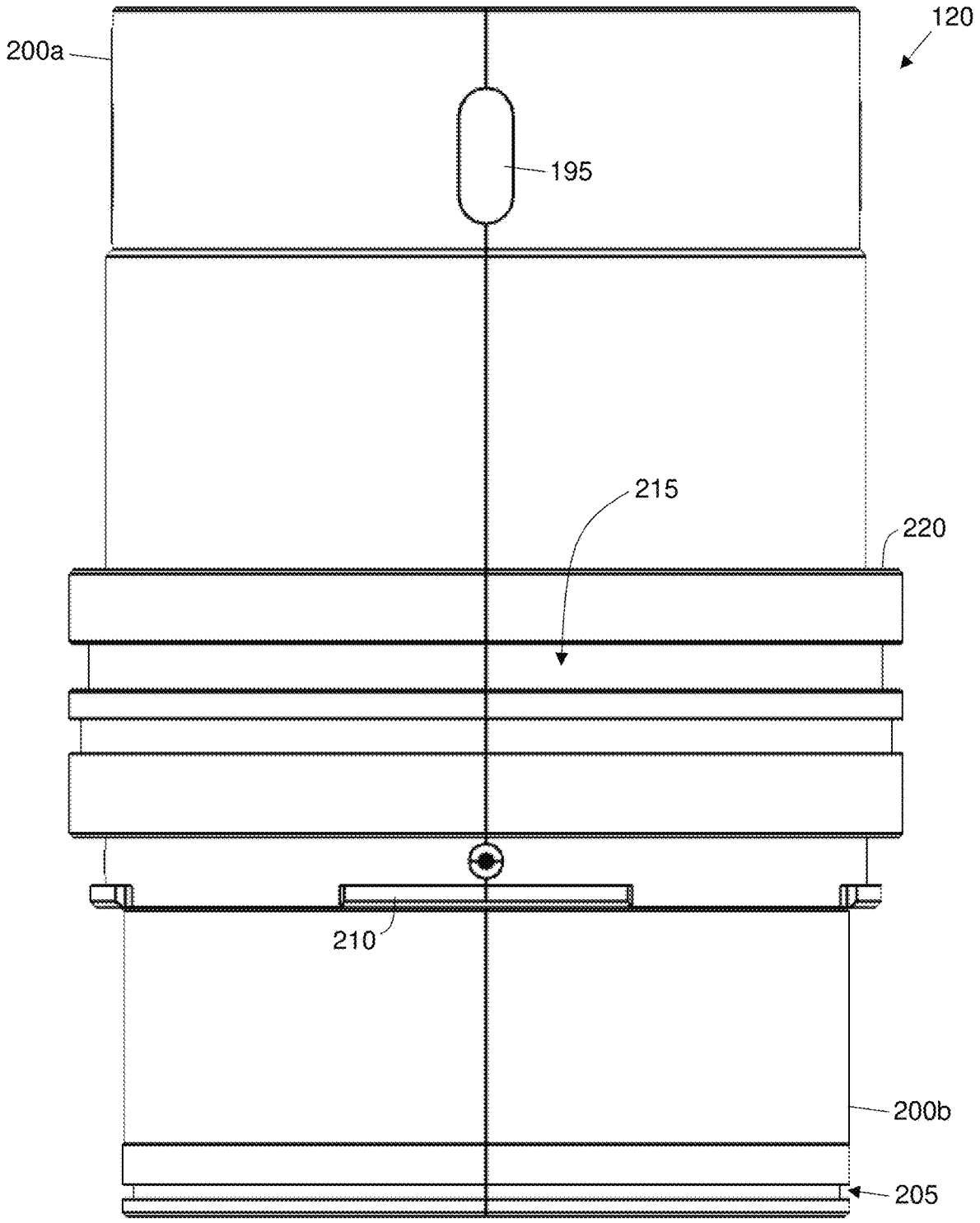
FIG. 5B is an elevational view of the upper body of FIG. 5A according to one or more embodiments of the present disclosure.

Referring to FIGS. 5A and 5B, the upper body 120 of the slip cartridge 100 shown in FIG. 1A is illustrated according to one or more embodiments. The upper body 120 is a tubular member defining a plurality of slots 195 (e.g., axially-extending slots) formed radially therethrough, and distributed circumferentially thereabout, proximate an end portion 200*a* thereof. One or more sealing components 205 (e.g., an external sealing groove) are defined at another end portion 200*b* of the upper body 120 (i.e., opposite the plurality of slots 195). Axially between the one or more sealing components 205 and the plurality of slots 195, the upper body 120 defines one or more latching components 210 (e.g., external latching component(s)). The upper body 120 also defines one or more sealing components 215 (e.g., another external sealing groove) axially between the one or more latching components 210 and the plurality of slots 195. An external shoulder 220 is also defined in the upper body 120 axially between the one or more sealing components 215 and the plurality of slots 195, facing toward the plurality of slots 195.

Figure 6:
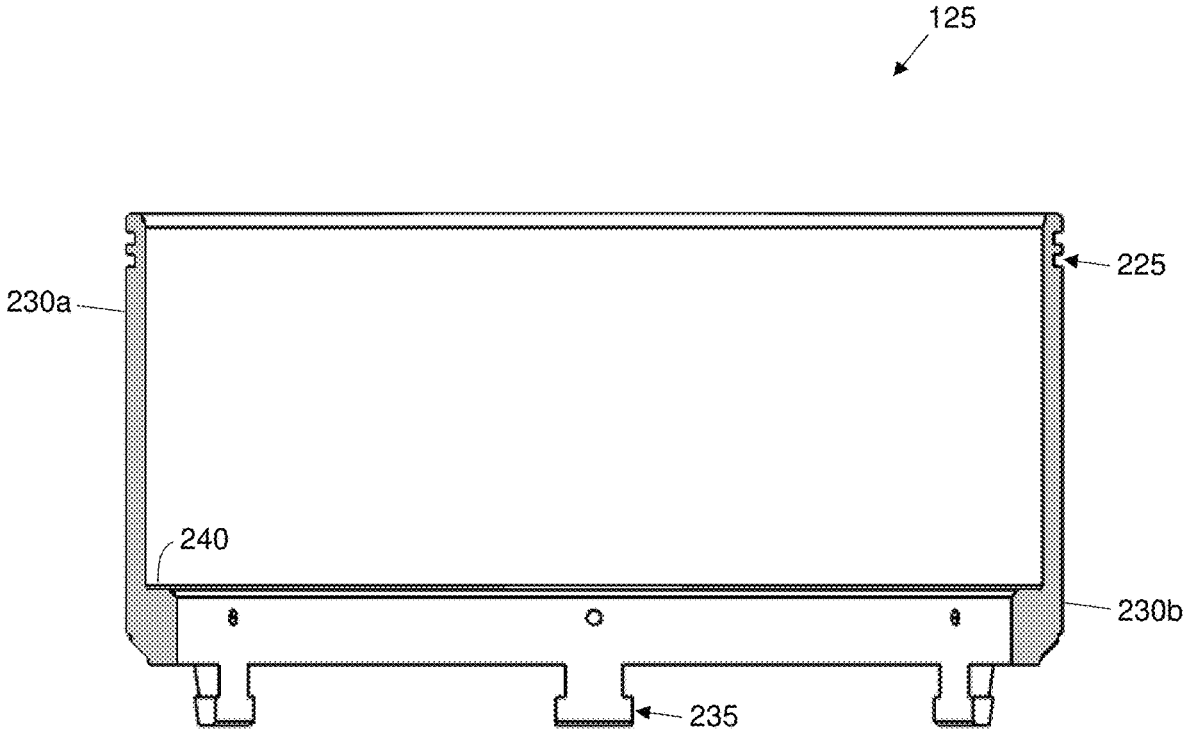
FIG. 6 is a cross-sectional view of a setting ring of the slip cartridge of FIG. 1A according to one or more embodiments of the present disclosure.

Referring to FIG. 6, the setting ring 125 of the slip cartridge 100 shown in FIG. 1A is illustrated according to one or more embodiments. The setting ring 125 is a tubular member defining one or more sealing components 225 (e.g., a pair of external sealing grooves) proximate an end portion 230*a* thereof. One or more latching components 235 are defined at another end portion 230*b* of the setting ring 125 (i.e., opposite the one or more sealing components 225). An internal shoulder 240 is also defined in the setting ring 125 axially between the one or more latching components 235 and the one or more sealing components 225, facing the one or more sealing components 225.

Figure 7:
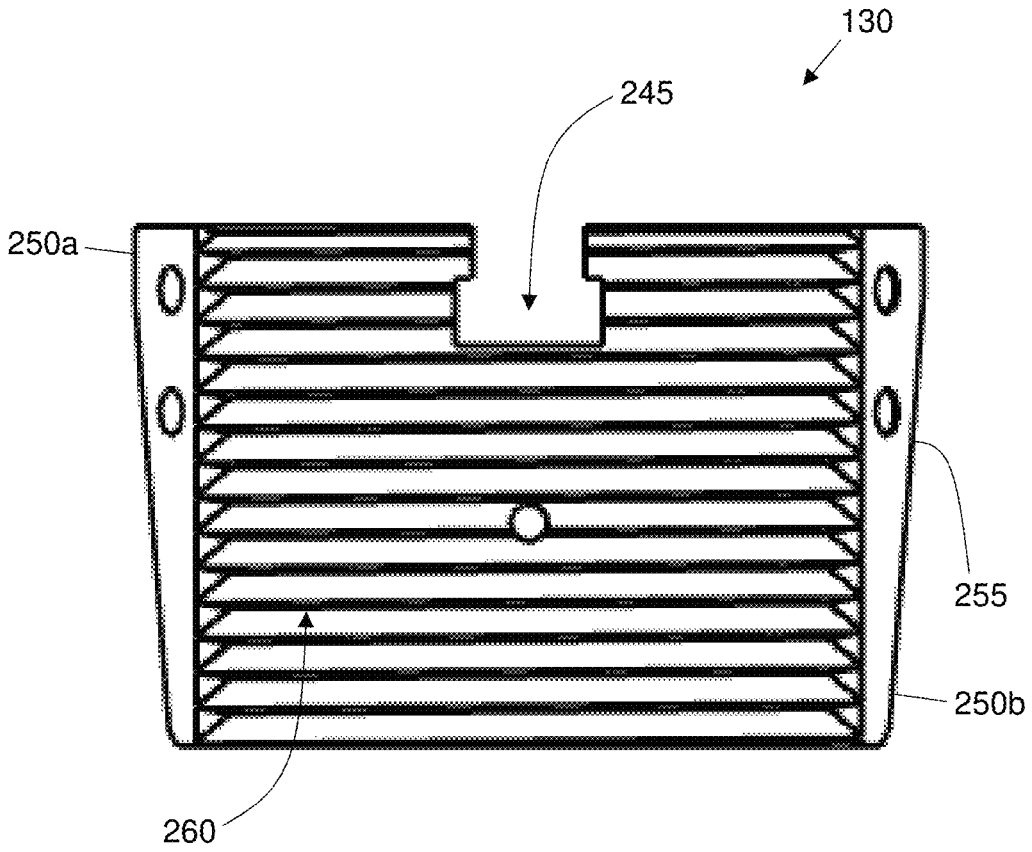
FIG. 7 is an elevational view of one of a plurality of slips of the slip cartridge of FIG. 1A according to one or more embodiments of the present disclosure.

Referring to FIG. 7, one of the plurality of slips 130 of the slip cartridge 100 shown in FIG. 1A is illustrated according to one or more embodiments. The slip 130 is an arcuate member defining a latching component 245 at an end portion 250*a* thereof. In one or more embodiments, when assembled, the latching component 245 defined by the slip 130 is radially engaged with, and disengageable from, a corresponding one of the one or more latching components 235 defined by the setting ring 125. An external surface 255 is defined in the slip 130, tapering radially inwardly toward another end portion 250*b* of the slip 130 (i.e., opposite the latching component 245). The slip 130 also defines a plurality of internal teeth 260, opposite the external surface 255.

Figure 8:
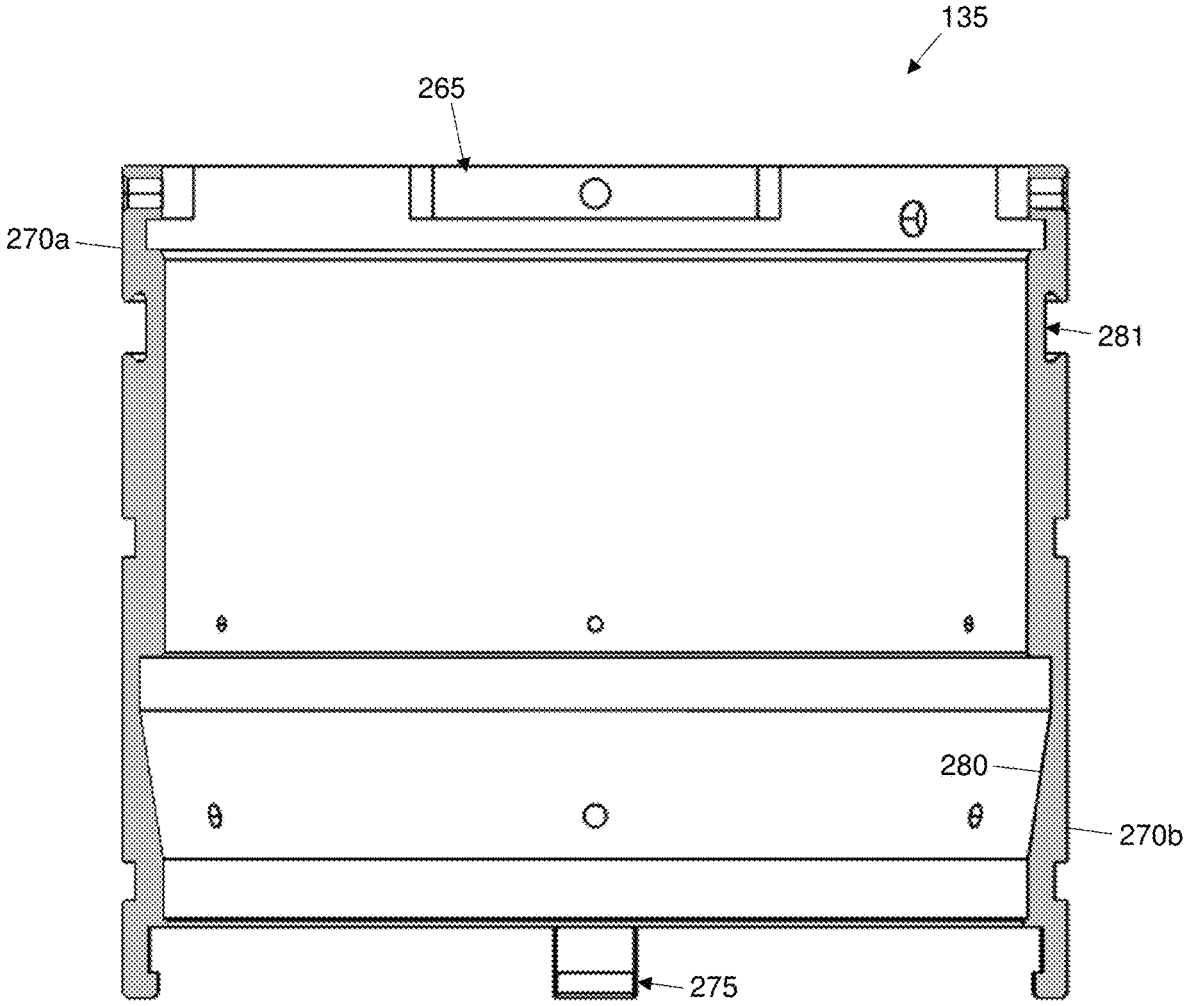
FIG. 8 is a cross-sectional view of a lower body of the slip cartridge of FIG. 1A according to one or more embodiments of the present disclosure.

Referring to FIG. 8, the lower body 135 of the slip cartridge 100 shown in FIG. 1A is illustrated according to one or more embodiments. The lower body 135 is a tubular member defining one or more latching components 265 (e.g., internal latching component(s)) at an end portion 270*a* thereof. In one or more embodiments, when assembled, the one or more latching components 265 defined by the lower body 135 are circumferentially engaged with, and disengageable from, the one or more latching components 210 defined by the upper body 120. One or more latching components 275 are defined at another end portion 270*b* of the lower body 135 (i.e., opposite the one or more latching components 265). Axially between the one or more latching components 265 and the one or more latching components 275, an internal surface 280 is defined in the lower body 135, tapering radially inwardly toward the one or more latching components 275. The lower body 135 also defines one or more sealing components 281 (e.g., yet another external sealing groove) axially between the internal surface 280 and the one or more latching components 265.

Figure 9A:
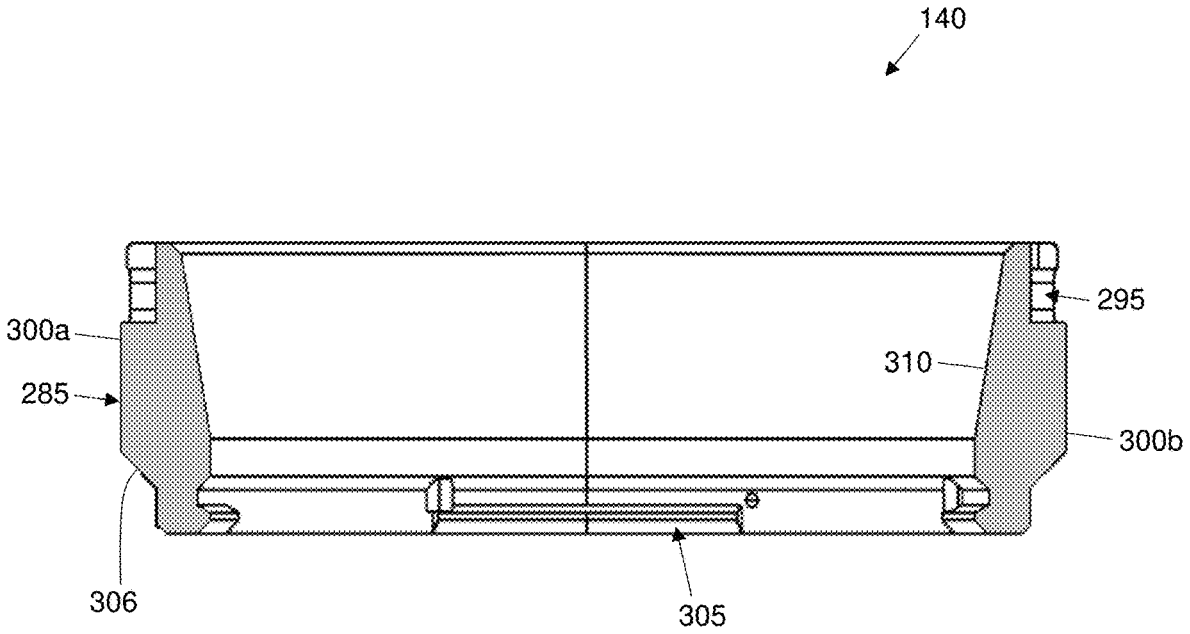
FIG. 9A is a cross-sectional view of a slip bowl of the slip cartridge of FIG. 1A according to one or more embodiments of the present disclosure.
Figure 9B:
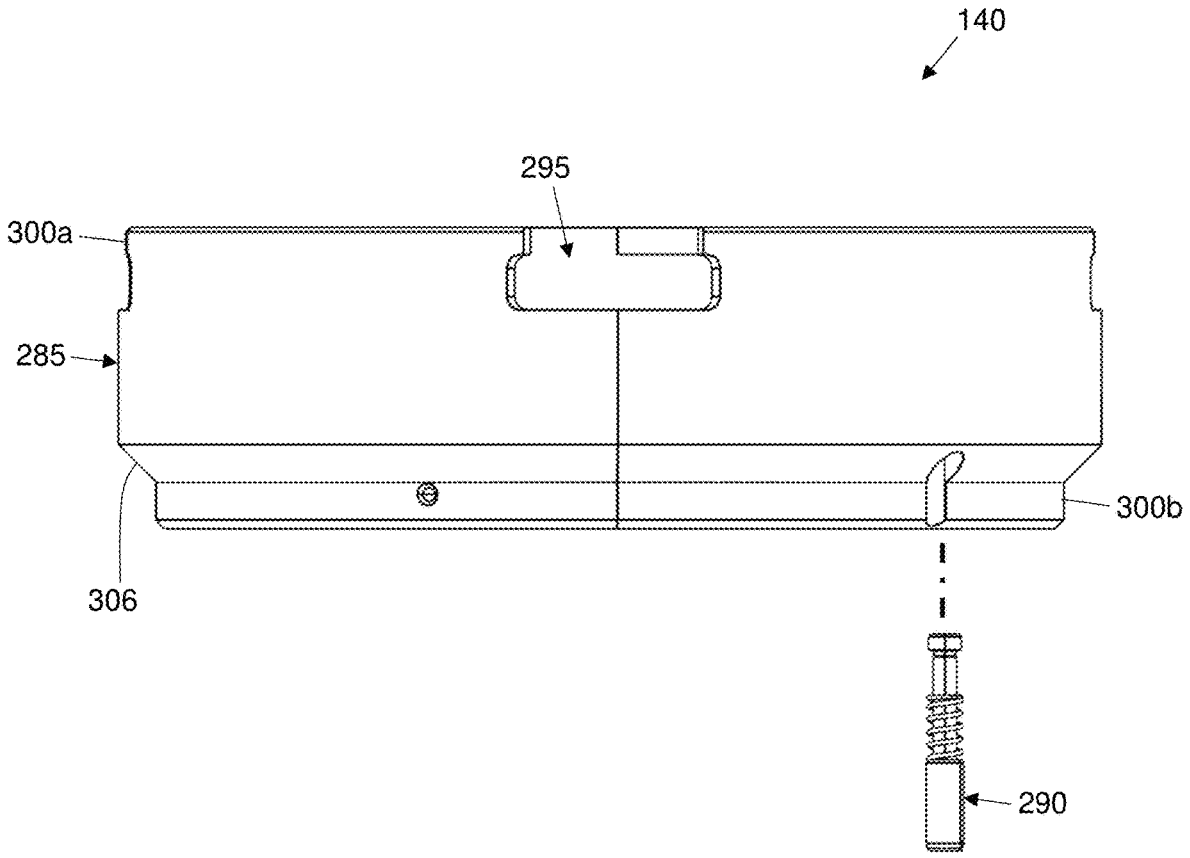
FIG. 9B is a partially-exploded elevational view of the slip bowl of FIG. 9A, said slip bowl including a bowl body and one or more spring pins according to one or more embodiments of the present disclosure.

Referring to FIGS. 9A and 9B, the slip bowl 140 of the slip cartridge 100 shown in FIG. 1A is illustrated according to one or more embodiments. The slip bowl 140 includes a bowl body 285 and one or more spring pins 290. The bowl body 285 is a tubular member defining one or more latching components 295 (e.g., external latching component(s)) at an end portion 300*a* thereof. In one or more embodiments, when assembled, the one or more latching components 295 defined by the bowl body 285 are circumferentially engaged with, and disengageable from, the one or more latching components 275 defined by the lower body 135. One or more latching components 305 (e.g., internal latching component(s)) are defined at another end portion 300*b* of the bowl body 285 (i.e., opposite the one or more latching components 295). The bowl body 285 also defines an external shoulder 306 (i.e., a "landing shoulder") proximate the end portion 300*b*, facing away from the end portion 300*a*. In one or more embodiments, the external shoulder 306 is tapered inwardly toward the end portion 300*b*. An internal surface 310 is defined in the bowl body 285, tapering radially inwardly toward the one or more latching components 305.

Figure 10A:
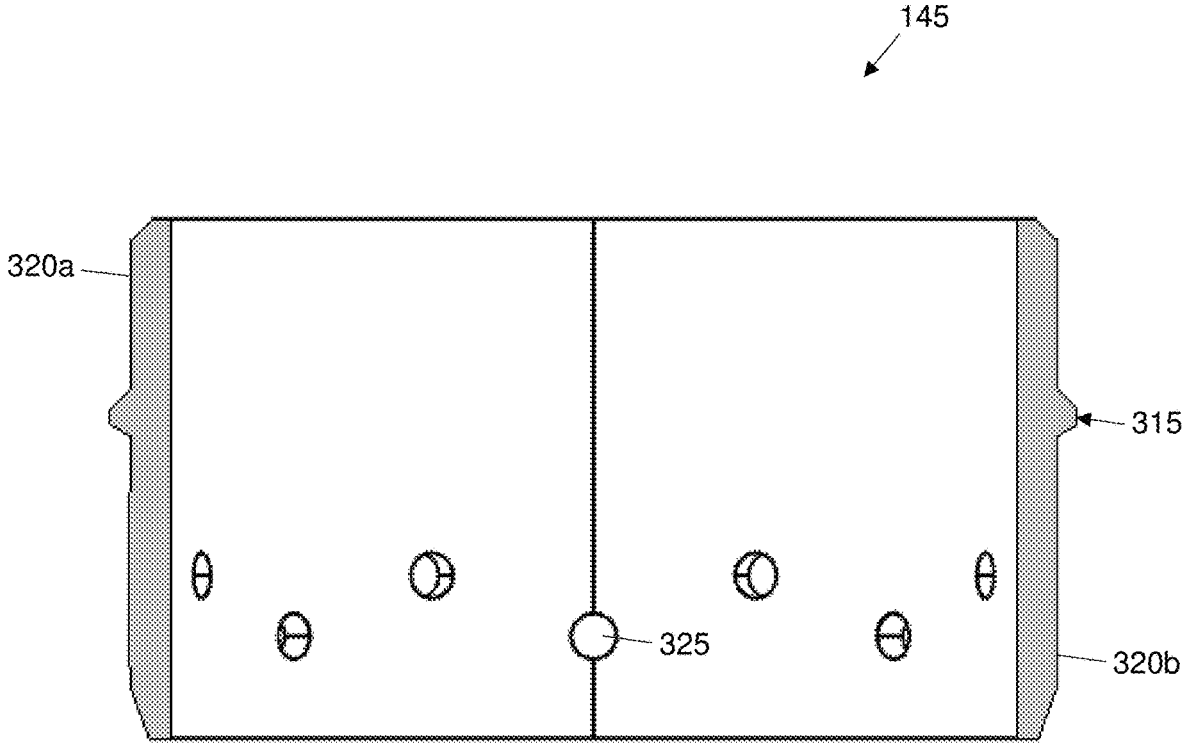
FIG. 10A is a cross-sectional view of a running collar of the slip cartridge of FIG. 1A according to one or more embodiments of the present disclosure.
Figure 10B:
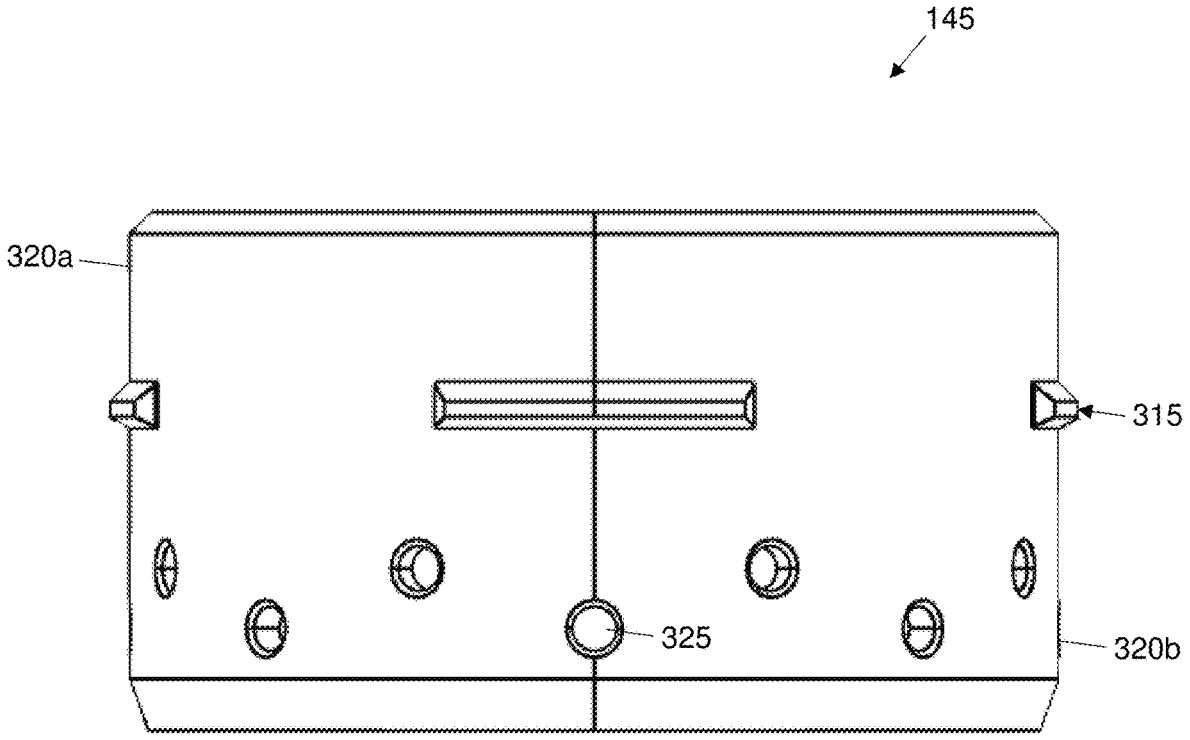
FIG. 10B is an elevational view of the running collar of FIG. 10A according to one or more embodiments of the present disclosure.

Referring to FIGS. 10A and 10B, the running collar 145 of the slip cartridge 100 shown in FIG. 1A is illustrated according to one or more embodiments. The running collar 145 is a tubular body defining one or more latching components 315 (e.g., external latching component(s)) at an end portion 320*a* thereof. In one or more embodiments, when assembled, the one or more latching components 315 defined by the running collar 145 are circumferentially engaged with, and disengageable from, the one or more latching components 305 defined by the bowl body 285 of the slip bowl 140. A plurality of openings 325 are formed radially through, and distributed circumferentially about, the running collar 145 proximate another end portion 320*b* of the running collar 145 (i.e., opposite the one or more latching components 315). In one or more embodiments, the slip cartridge 100 includes the running collar 145. In one or more embodiments, the slip cartridge 100 is detachably coupled to the running collar 145. In one or more embodiments, the slip cartridge 100 includes the running collar 145 at least when the slip cartridge 100 is detachably coupled to the running collar 145.

Figure 11:
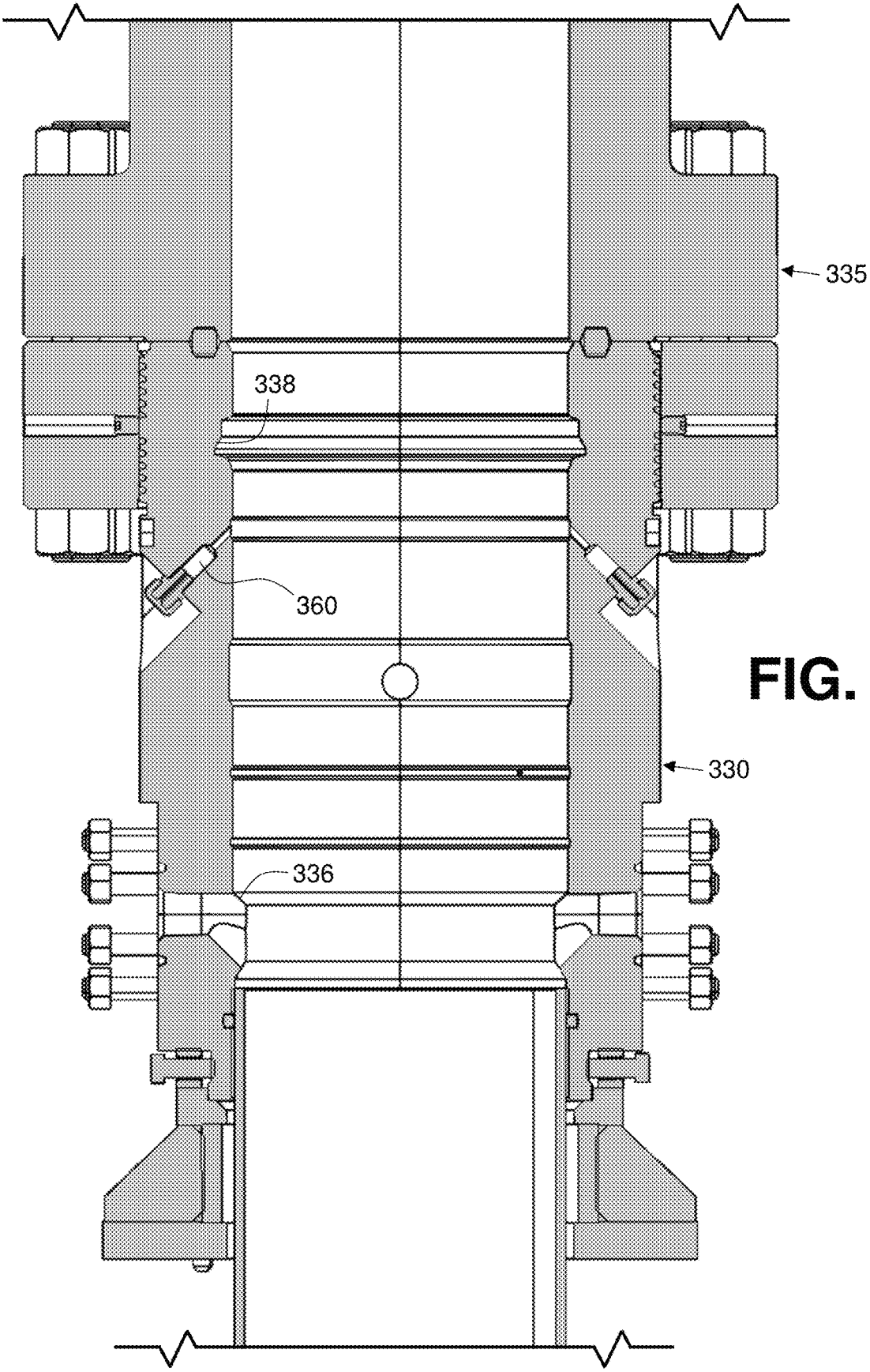
FIG. 11 is a cross-sectional view of a casing head atop which a blowout preventer ("BOP") is operably coupled according to one or more embodiments of the present disclosure.

Referring to FIG. 11, a casing head 330, atop which a blowout preventer ("BOP") 335 is operably coupled, is illustrated according to one or more embodiments. The casing head 330 may be, include, or be part of a wellhead. The casing head defines an internal shoulder 336 (i.e., a "landing shoulder") engageable by the external shoulder 306 to "land" the slip cartridge 100 within the casing head 330, as will be described in further detail below. The casing head 330 also defines an internal recess 338 (e.g., an annular recess) adapted to receive the locking ring 115 when: the slip cartridge 100 is landed within the casing head 330; and the locking ring 115 is expanded by the expansion collar 165 of the locking sleeve 110. In one or more embodiments, the casing head 330 is part of a system, which system also includes: the slip cartridge 100 (shown and described above in connection with FIGS. 1A through 1D); and a tubular string 340 (shown and described below in connection with FIGS. 12A-1 through 12D-2).

Figures 1, 12A:
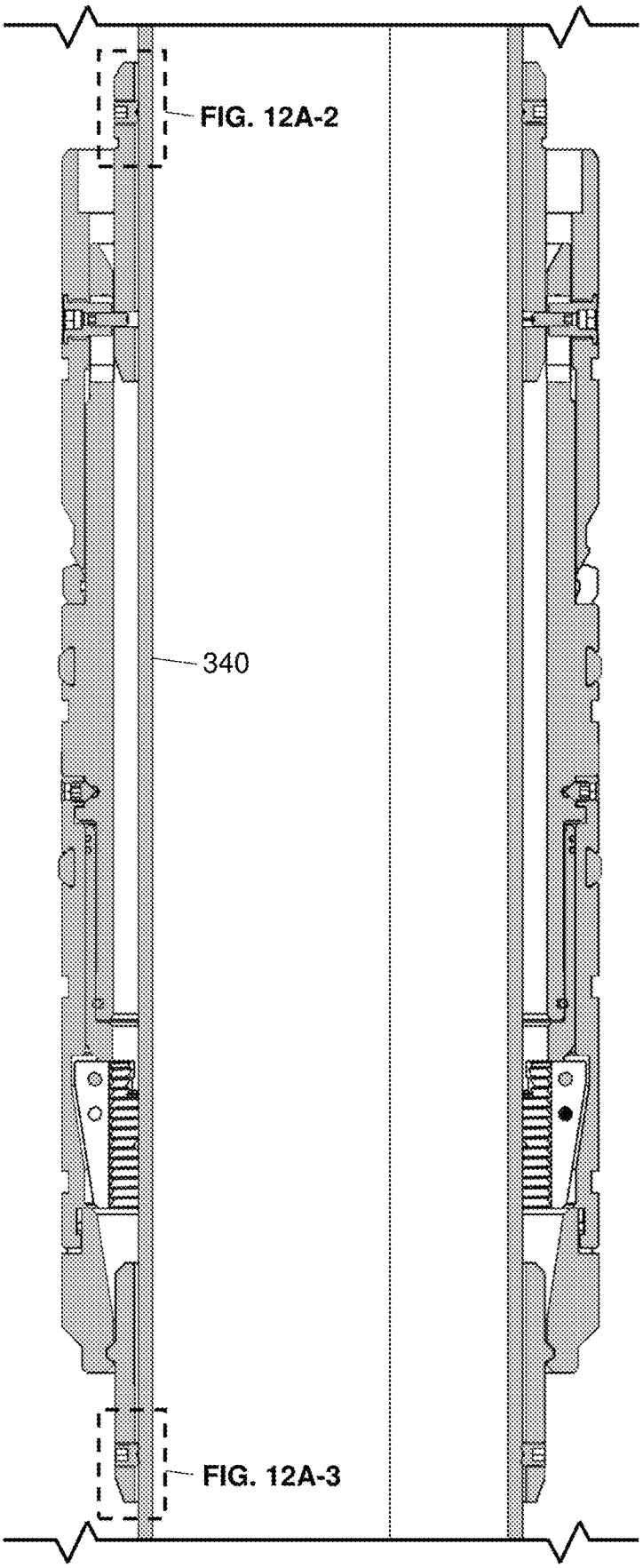
FIG. 12A-1 is a cross-sectional view of the slip cartridge of FIG. 1A installed on a tubular string according to one or more embodiments of the present disclosure.
Figures 2, 12A:
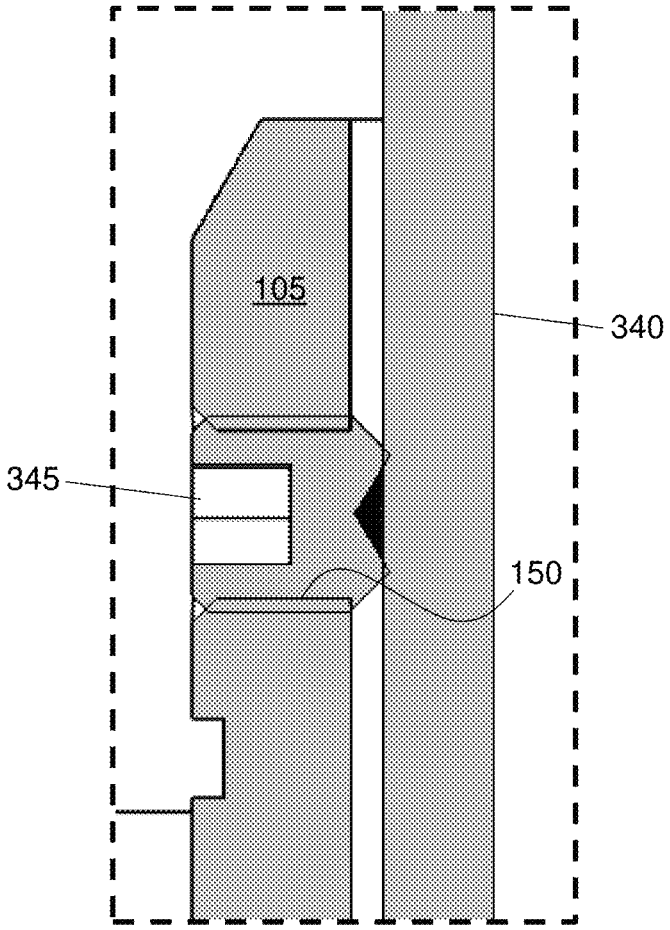
Figures 3, 12A:
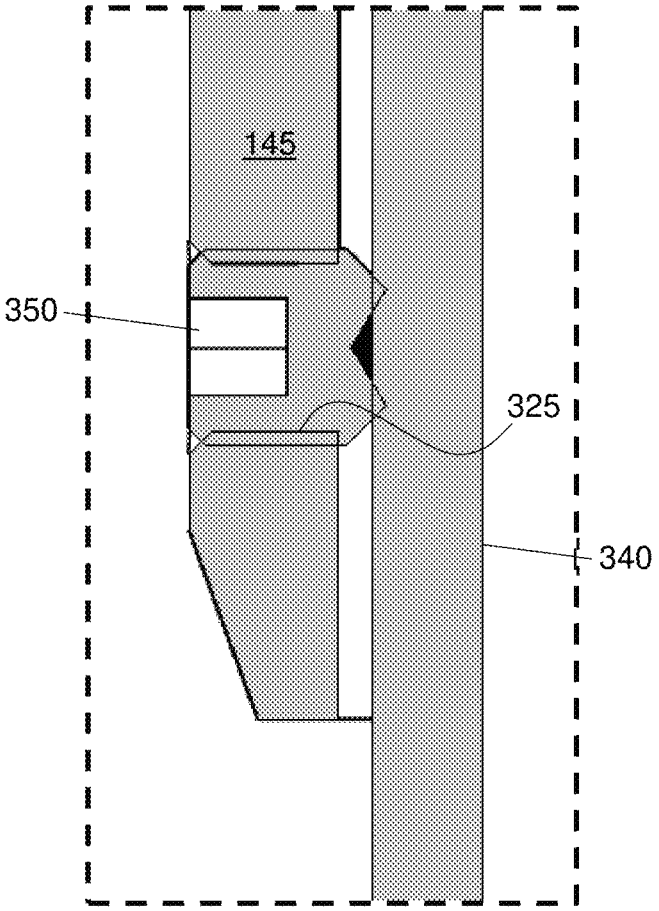

Referring to FIGS. 12A-1 through 12A-3, the slip cartridge 100 of FIG. 1A is illustrated in a second operational state or configuration, in which the slip cartridge 100 is installed on the tubular string 340, according to one or more embodiments. In the second operational state or configuration: the locking collar 105 is or remains secured to the tubular string 340 via engagement of a plurality of fasteners 345 (e.g., set screws) with the corresponding plurality of openings 150 defined by the locking collar 105, as shown in FIG. 12A-2; and the running collar 145 is or remains secured to the tubular string 340 via engagement of a plurality of fasteners 350 (e.g., set screws) with the corresponding plurality of openings 325 defined by the running collar 145, as shown in FIG. 12A-3.

Figures 1, 12B:
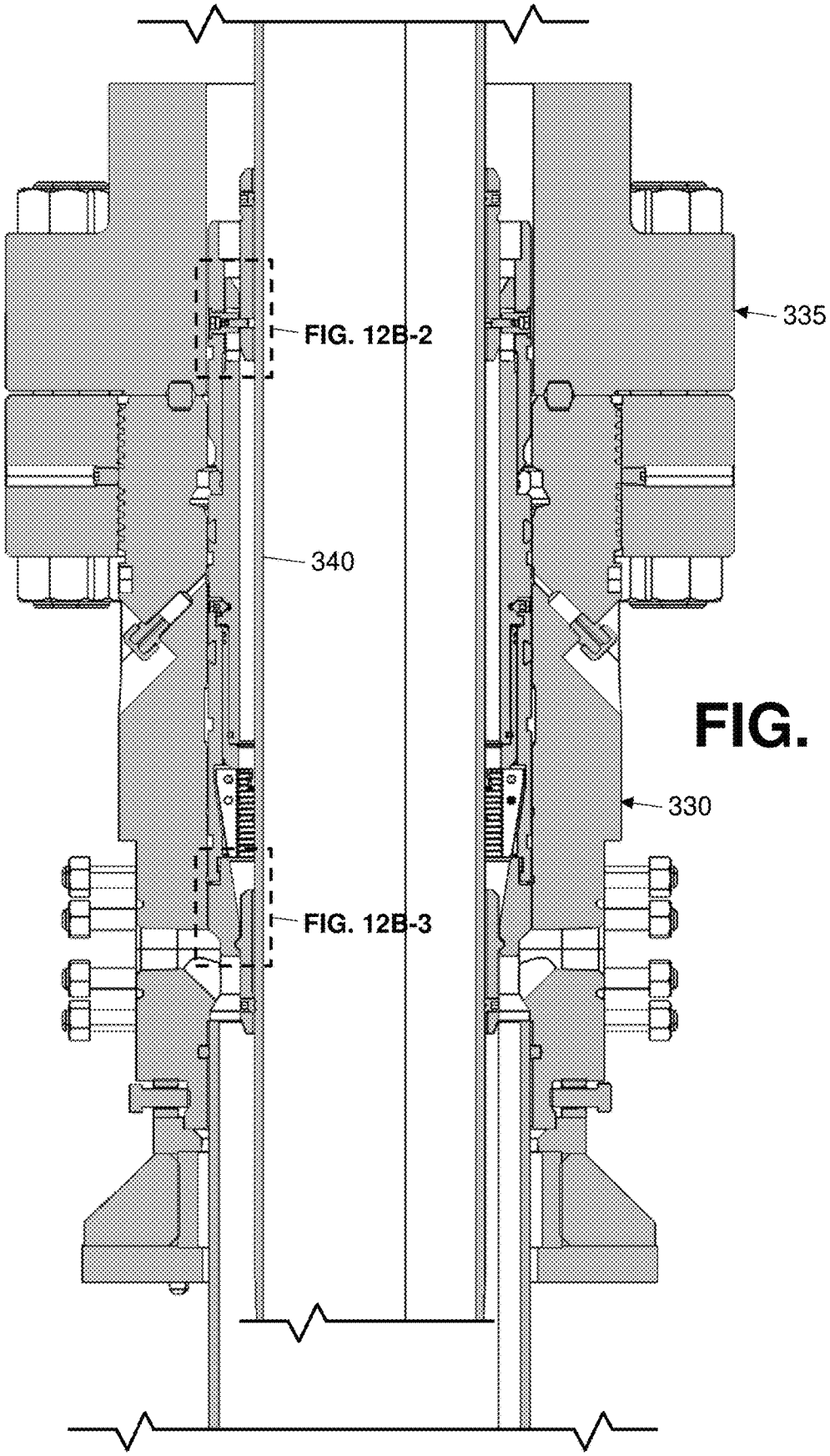
Figures 2, 12B:
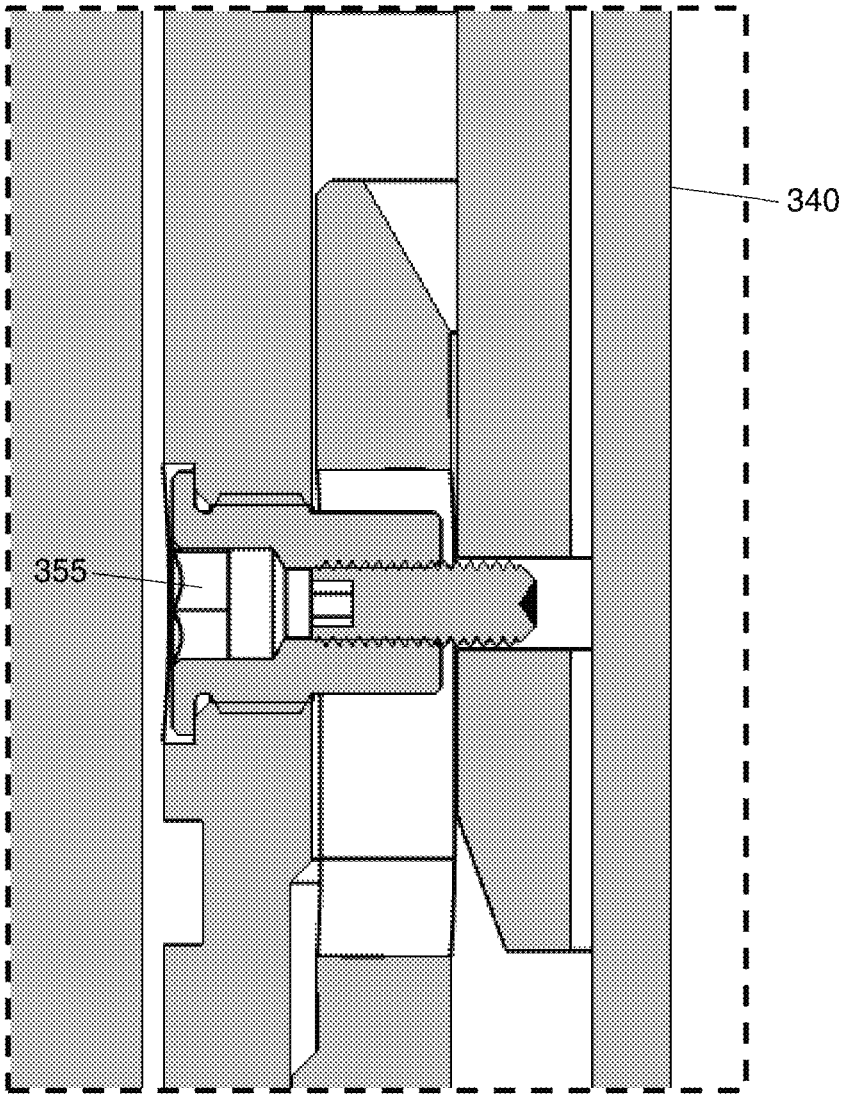
Figures 3, 12B:
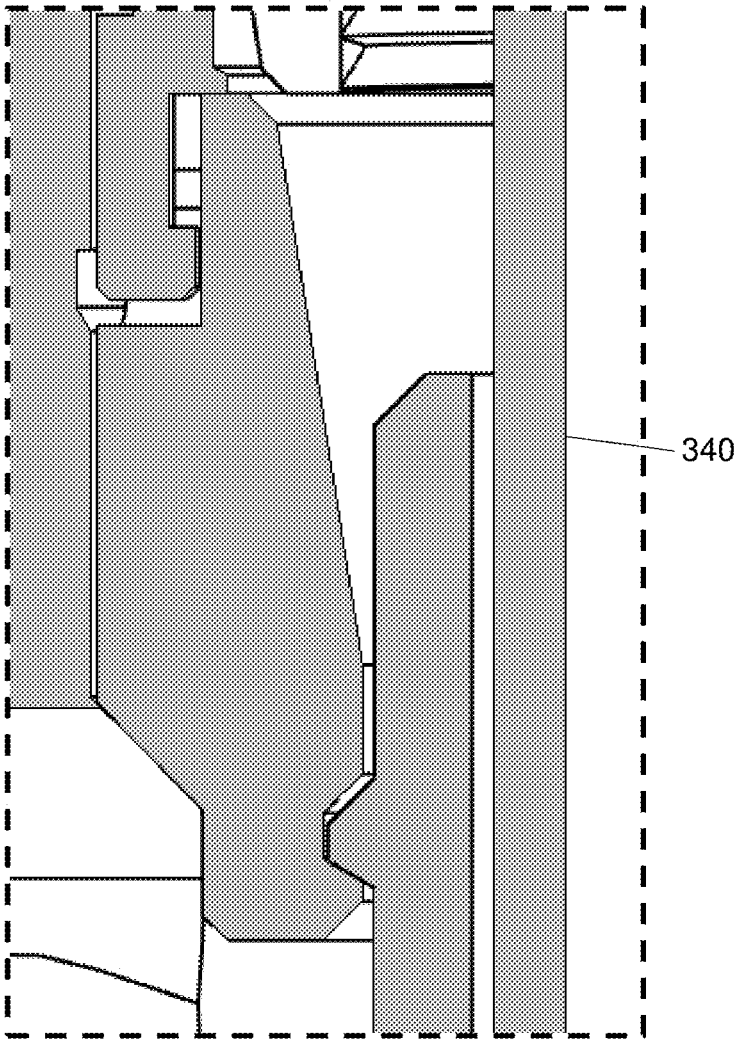

Referring to FIGS. 12B-1 through 12B-3, the slip cartridge 100 of FIG. 1A is illustrated in a third operational state or configuration, in which the slip cartridge 100 is landed in the casing head 330 of FIG. 11 using the tubular string 340 of FIG. 12A-1, according to one or more embodiments. In the third operational state or configuration: the locking sleeve 110 is or remains secured to the locking collar 105 via engagement of a plurality of fasteners 355 (e.g., shearable fasteners) through the corresponding plurality of slots 195 and 160 defined in the upper body 120 and the locking collar 105, respectively (with each of the plurality of fasteners 355 extending at a first circumferential position within the corresponding slot 160 defined in the locking collar 105, and extending at a first axial position within the corresponding slot 195 defined in the upper body 120), as shown in FIG. 12B-2; the external shoulder 306 defined by the bowl body 285 of the slip bowl 140 is landed on the internal shoulder 336 defined by the casing head 330, as shown in FIG. 12B-3; and the one or more latching components 315 defined by the running collar 145 are circumferentially engaged with the one or more latching components 305 defined by the bowl body 285 of the slip bowl 140 to prevent, or at least reduce, axial displacement of the running collar 145 relative to the bowl body 285 of the slip bowl 140, as shown in FIG. 12B-3.

Figures 1, 12C:
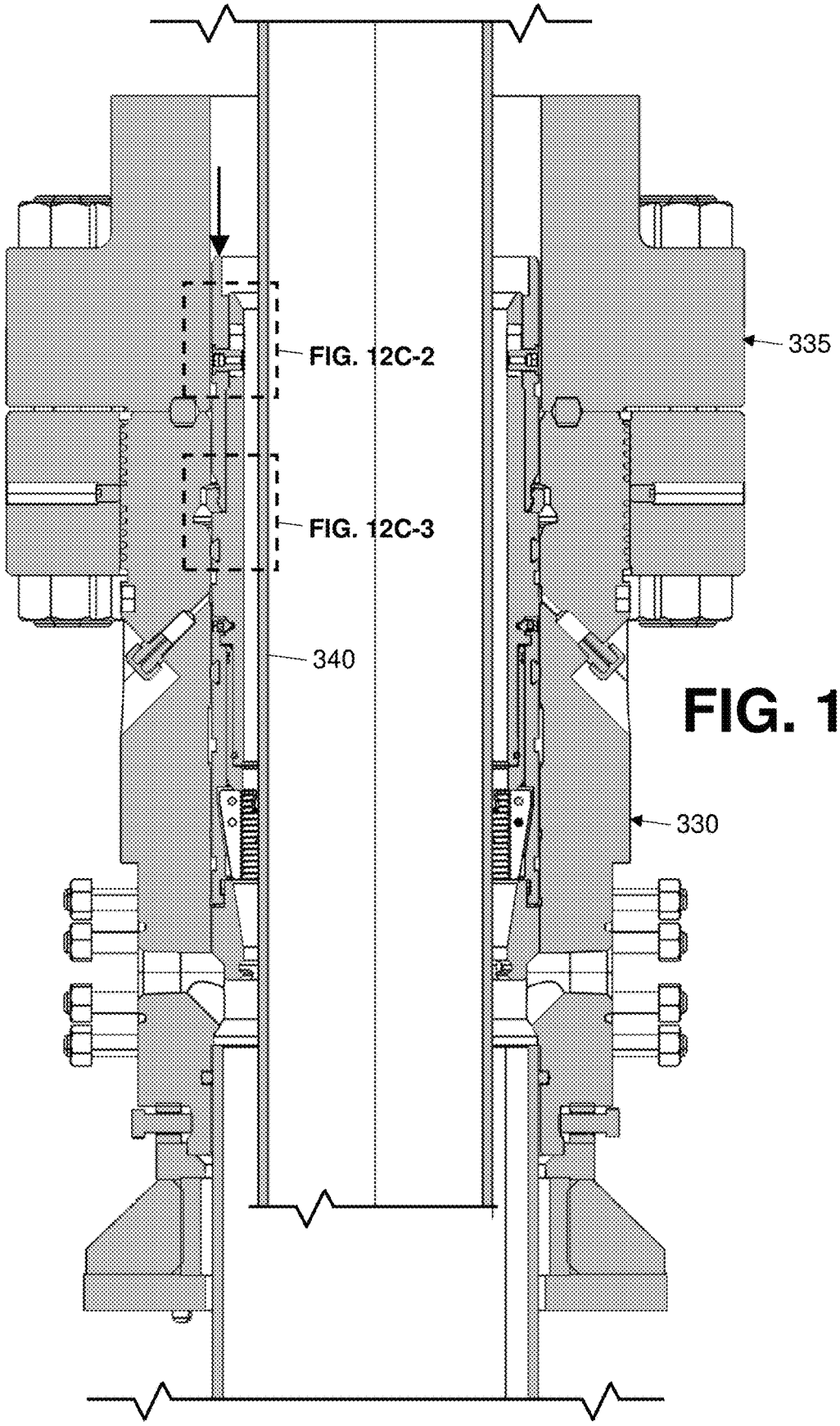
Figures 2, 12C:
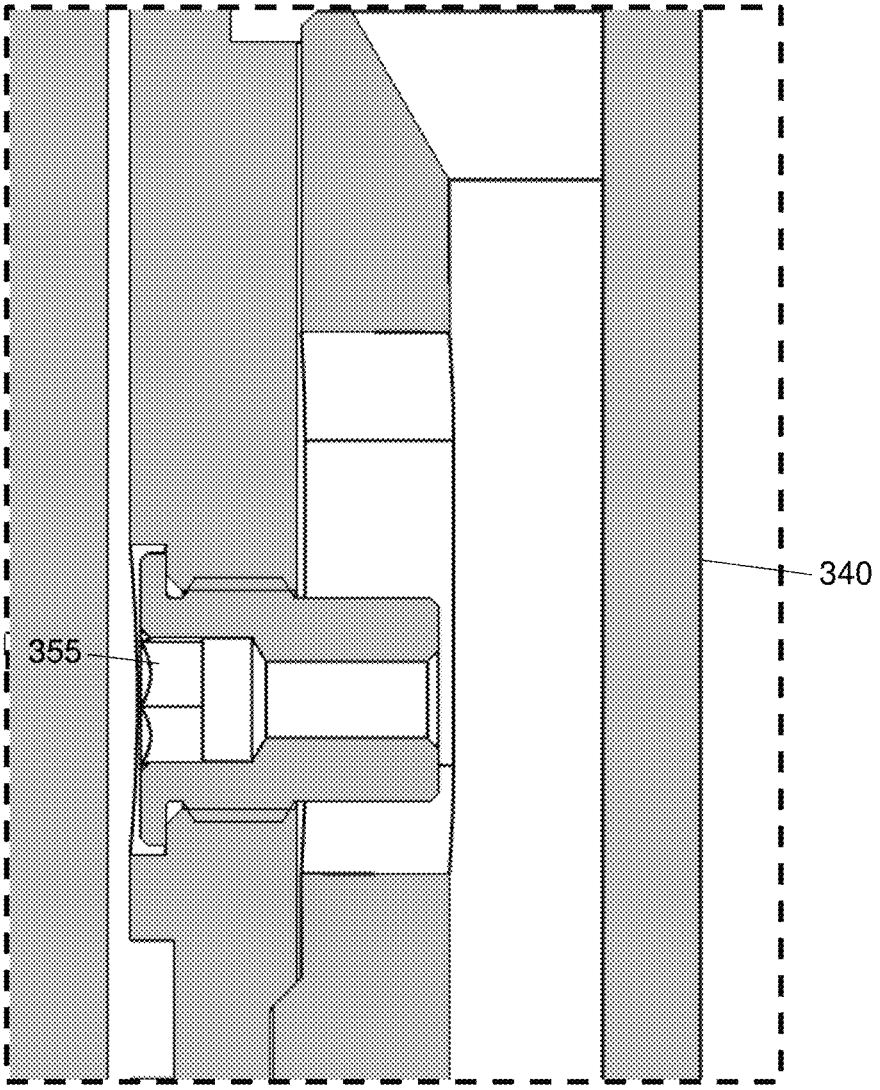
Figures 3, 12C:
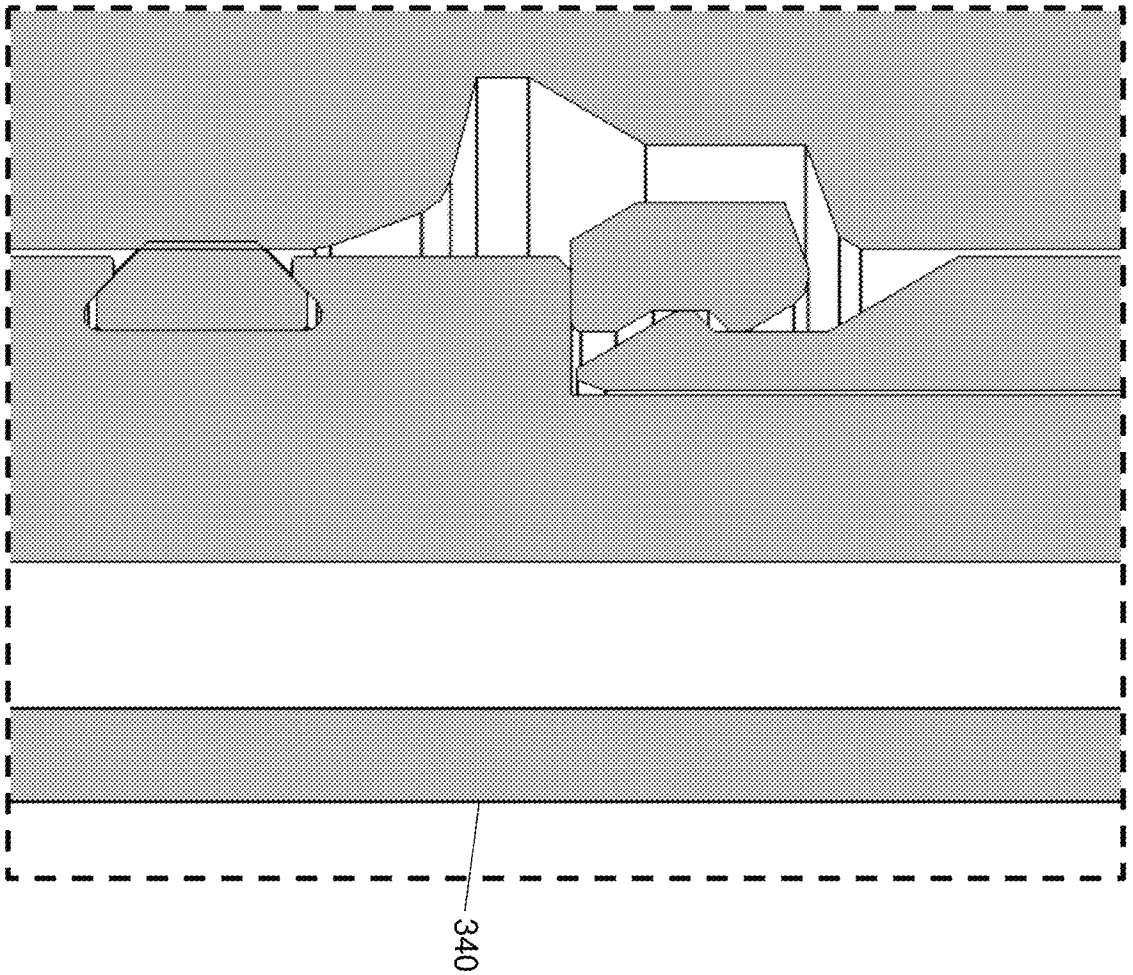

Referring to FIGS. 12C-1 through 12C-3, the slip cartridge 100 of FIG. 1A is illustrated in a fourth operational state or configuration, in which the landed slip cartridge 100 is locked in the casing head 330 of FIG. 11 using the tubular string 340 of FIG. 12A-1, according to one or more embodiments. In the fourth operational state or configuration: the tubular string 340 is rotated to circumferentially disengage the one or more latching components 315 defined by the running collar 145 from the one or more latching components 305 defined by the bowl body 285 of the slip bowl 140, thereby allowing axial displacement of the running collar 145 relative to the bowl body 285 of the slip bowl 140; the tubular string 340 (and thus the circumferentially disengaged running collar 145) is displaced axially to thereby axially displace the locking sleeve 110 via the locking collar 105 and the plurality of fasteners 355 extending through the corresponding plurality of slots 195 and 160 defined in the upper body 120 and the locking collar 105, respectively (causing each of the plurality of fasteners 355 to extend at a second circumferential position within the corresponding slot 160 defined in the locking collar 105, and to extend at a second axial position within the corresponding slot 195 defined in the upper body 120, as shown in FIG. 12C-2); and the expansion collar 165 defined by the locking sleeve 110 expands the locking ring 115 into the internal recess 338 defined by the casing head 330 to thereby lock the slip cartridge 100 within the casing head 330, as shown in FIG. 12C-3.

Figures 1, 12D:
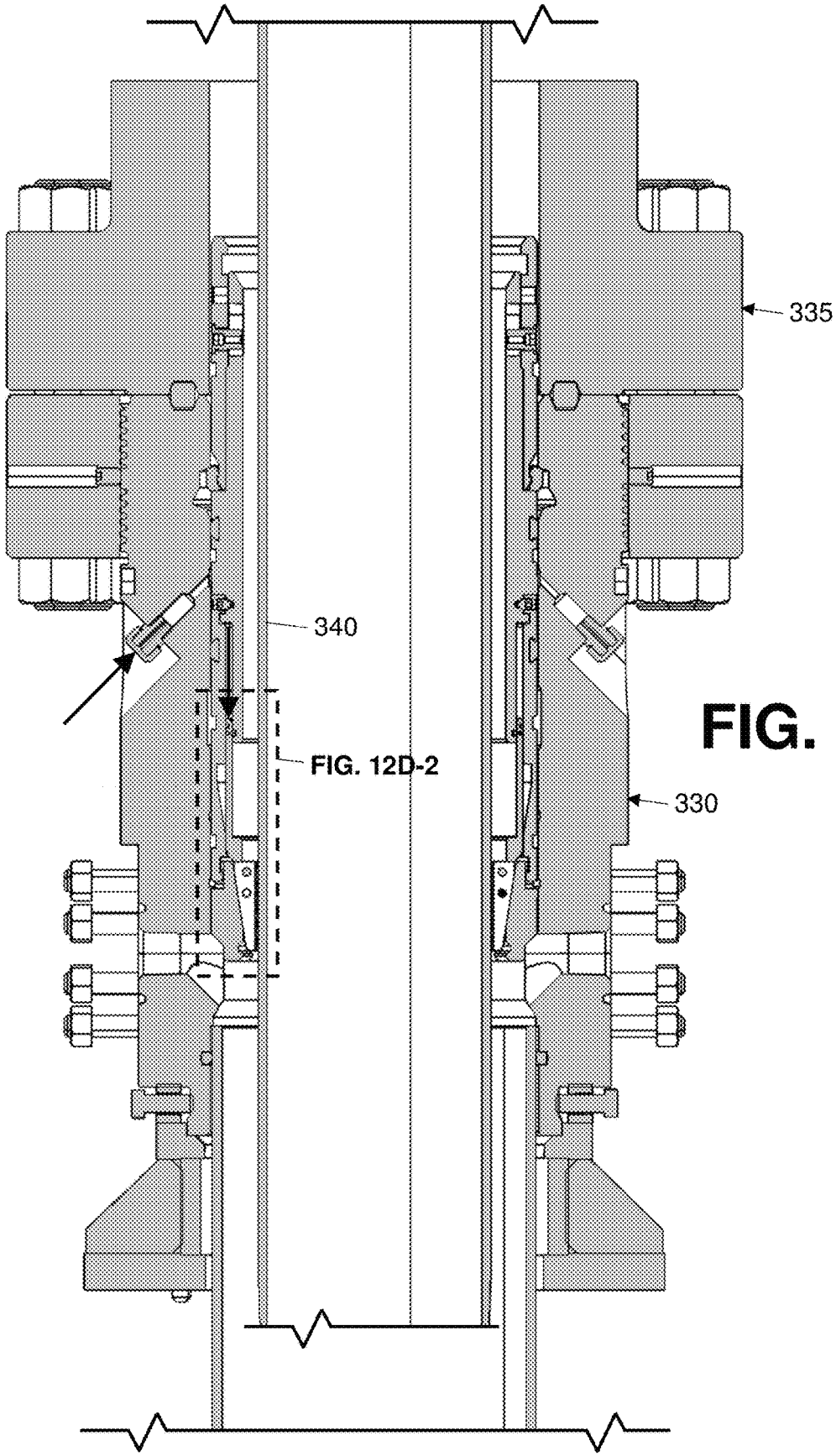
Figures 2, 12D:
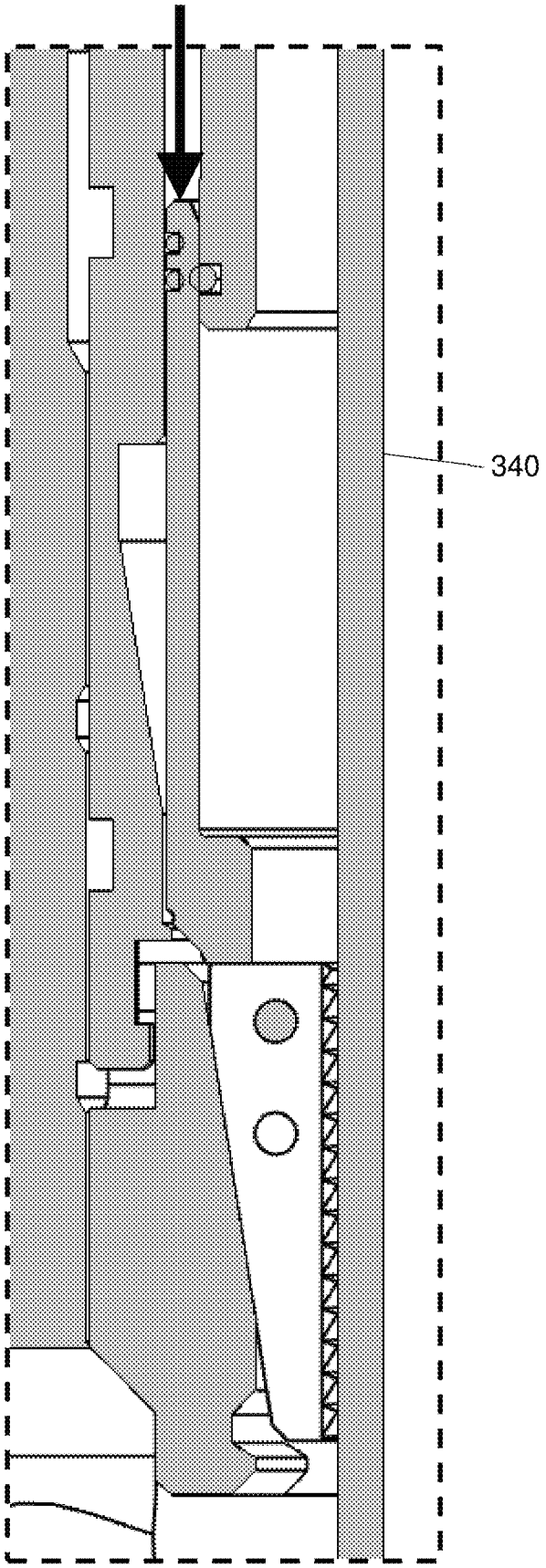

Referring to FIGS. 12D-1 through 12D-2, the slip cartridge 100 of FIG. 1A is illustrated in a fifth operational state or configuration, in which the locked slip cartridge 100 is set in the casing head 330 of FIG. 11 using the setting ring 125 of FIG. 6, the plurality of slips 130 (one of which is shown in FIG. 7), and the slip bowl 140 of FIGS. 9A-9B, according to one or more embodiments. In the fifth operational state or configuration: external pressure is provided, via one or more ports 360 (also visible in FIG. 11) defined by the casing head 330, to axially displace the setting ring 125 (and thus the plurality of slips 130) relative to the slip bowl 140, as shown in FIG. 12D-2; the axial displacement of the plurality of slips 130 causes sliding engagement between the internal surfaces 280 and 310 of the lower body 135 and the slip bowl 140, respectively, and the corresponding external surfaces 255 of the plurality of slips 130; and the sliding engagement between the internal surfaces 280 and 310 of the lower body 135 and the slip bowl 140, respectively, and the respective external surfaces 255 of the plurality of slips 130 causes radially inward displacement of the plurality of slips 130 into engagement with the tubular string 340, as shown in FIG. 12D-2, at least until the latching components 245 defined by the respective plurality of slips 130 are radially disengaged from the one or more latching components 235 defined by the setting ring 125 (thereby allowing axial displacement (and thus removal) of the setting ring 125 relative to the plurality of slips 130, as described in more detail below in connection with the cutting tool illustratively disclosed in Appendix B of the '255 Application).

In one or more embodiments, one or more of the embodiments of the present application are provided in whole or in part as described and illustrated in the '310 Patent, the entire disclosure of which is has been incorporated herein by reference.

In one or more embodiments, one or more of the embodiments of the present application are provided in whole or in part as described in the '255 Application, the entire disclosure of which, including Appendices A and B, has been incorporated herein by reference. Amongst other disclosure, Appendix B of the '255 Application provides illustrative support for a cutting tool: including one or more latching components adapted to circumferentially engage the one or more latching components 180 defined by the locking sleeve 110; once so engaged, adapted to cut the tubular string 340 from inside; and, once so cut, adapted to remove the cut portion of the tubular string 340, together with the locking sleeve 110, the (now unexpanded) locking ring 115, the upper body 120, the setting ring 125, and the lower body 135, leaving behind the plurality of slips 130, the slip bowl 140, and the remaining tubular string 340. In one or more embodiments, the slip cartridge 100 defines a landing surface (e.g., at the end portion 200*a* of the upper body 120) for the cutting tool to properly space the cut within the tubular string 340 (and relative to the casing head 330, the slip bowl 140, and the plurality of slips 130 set within the slip bowl 140) without the need for any measurements taken at the rig.

In one or more embodiments, one or more of the embodiments described above and shown FIGS. 1A through 12D-2 are combined in whole or in part with one or more of the embodiments described and illustrated in the '310 Patent, one or more of the embodiments described and illustrated in the '255 Application, including Appendices A and B thereof, and/or one or more of the other embodiments described above and shown in FIGS. 1A through 12D-2.

A first method has been disclosed, according to one or more embodiments of the present disclosure. The first method generally includes: installing a slip cartridge on a tubular string by securing a running collar to which the slip cartridge is detachably coupled to a first segment of the tubular string; landing the slip cartridge in a wellhead by conveying the tubular string on which the slip cartridge is installed through the wellhead and into a wellbore; leaving behind the slip cartridge landed in the wellhead by detaching and removing the running collar from the slip cartridge; setting the slip cartridge in the wellhead by securing a plurality of slips of the slip cartridge to a second segment of the tubular string; and, after setting the slip cartridge in the wellhead: leaving behind a remainder of the tubular string extending from the wellhead into the wellbore by cutting off and removing a portion of the tubular string above the second segment; leaving behind a remainder of the slip cartridge, including at least the plurality of slips and a slip bowl of the slip cartridge, by: detaching and removing one or more body portions of the slip cartridge from the slip bowl, wherein the slip bowl supports the plurality of slips secured to the second segment of the tubular string; and detaching and removing a setting ring of the slip cartridge from the plurality of slips, wherein securing the plurality of slips of the slip cartridge to the second segment of the tubular string includes effecting relative movement of the setting ring and the plurality of slips together relative to the slip bowl. In one or more embodiments, installing the slip cartridge on the tubular string further includes securing a locking collar to which the slip cartridge is detachably coupled to a third segment of the tubular string; and the first method further includes locking the slip cartridge in the wellhead by effecting relative movement of the tubular string, the locking collar, and a locking sleeve of the slip cartridge together relative to one or more body portions of the slip cartridge. In one or more embodiments, the first method further includes detaching and removing the locking collar from the slip cartridge by effecting relative movement of the tubular string and the locking collar together relative to the one or more body portions and the locking sleeve. In one or more embodiments, the first method further includes, after setting the slip cartridge in the wellhead, unlocking the slip cartridge from the wellhead by effecting movement of the locking sleeve relative to the one or more body portions. In one or more embodiments, landing the slip cartridge in the wellhead further includes conveying the slip cartridge installed on the tubular string through a blowout preventer ("BOP") mounted atop the wellhead.

A first apparatus has also been disclosed, according to one or more embodiments of the present disclosure. The first apparatus generally includes: a tubular string; a running collar; and a slip cartridge, wherein the slip cartridge is detachably coupled to the running collar; wherein the slip cartridge includes a setting ring, a plurality of slips, a slip bowl, and one or more body portions; wherein the slip cartridge is adapted to be: installed on the tubular string by securing the running collar to a first segment of the tubular string; landed in a wellhead by conveying the tubular string on which the slip cartridge is installed through the wellhead and into a wellbore; left behind landed in the wellhead by detaching and removing the running collar from the slip cartridge; and set by securing the plurality of slips to a second segment of the tubular string; wherein the setting ring is adapted to set the slip cartridge by effecting relative movement of the plurality of slips relative to the slip bowl to secure the plurality of slips to the second segment of the tubular string; and wherein, when the slip cartridge is set: a remainder of the tubular string extending from the wellhead into the wellbore is adapted to be left behind by cutting off and removing a portion of the tubular string above the second segment; the slip bowl supports the plurality of slips; a remainder of the slip cartridge, including at least the plurality of slips and the slip bowl, is adapted to be left behind set in the wellhead by: detaching and removing the one or more body portions from the slip bowl; and detaching and removing the setting ring from the plurality of slips. In one or more embodiments, the first apparatus further includes a locking collar, wherein the slip cartridge further includes one or more body portions and a locking sleeve via which the slip cartridge is detachably coupled to the locking collar; and wherein the slip cartridge is further adapted to be: installed on the tubular string by securing the locking collar to a third segment of the tubular string; and locked in the wellhead by effecting movement of the tubular string, the locking collar, and the locking sleeve together relative to the one or more body portions. In one or more embodiments, the locking collar is adapted to be detached and removed from the slip cartridge by effecting relative movement of the tubular string and the locking collar together relative to the one or more body portions and the locking sleeve. In one or more embodiments, when the slip cartridge is set, the slip cartridge is further adapted to be unlocked from the wellhead by effecting movement of the locking sleeve relative to the one or more body portions. In one or more embodiments, the slip cartridge is further adapted to be landed in the wellhead by conveying the slip cartridge installed on the tubular string through a blowout preventer ("BOP") mounted atop the wellhead.

A second method has also been disclosed, according to one or more embodiments of the present disclosure. The second method generally includes: installing a slip cartridge on a tubular string by securing a running collar to which the slip cartridge is detachably coupled to a first segment of the tubular string; landing the slip cartridge in a wellhead by conveying the tubular string on which the slip cartridge is installed through the wellhead and into a wellbore; leaving behind the slip cartridge landed in the wellhead by detaching and removing the running collar from the slip cartridge; and setting the slip cartridge in the wellhead by securing a plurality of slips of the slip cartridge to a second segment of the tubular string. In one or more embodiments, the second method further includes, after setting the slip cartridge in the wellhead, leaving behind a remainder of the tubular string extending from the wellhead into the wellbore by cutting off and removing a portion of the tubular string above the second segment. In one or more embodiments, the second method further includes, after setting the slip cartridge in the wellhead, leaving behind a remainder of the slip cartridge, including at least the plurality of slips and a slip bowl of the slip cartridge, by detaching and removing one or more body portions of the slip cartridge from the slip bowl, wherein the slip bowl supports the plurality of slips secured to the second segment of the tubular string. In one or more embodiments, the second method further includes, after setting the slip cartridge in the wellhead, leaving behind a remainder of the slip cartridge, including at least the plurality of slips and a slip bowl of the slip cartridge, by detaching and removing a setting ring of the slip cartridge from the plurality of slips, wherein securing the plurality of slips of the slip cartridge to the second segment of the tubular string includes effecting relative movement of the setting ring and the plurality of slips together relative to the slip bowl; and wherein the slip bowl supports the plurality of slips secured to the second segment of the tubular string. In one or more embodiments, installing the slip cartridge on the tubular string further includes securing a locking collar to which the slip cartridge is detachably coupled to a third segment of the tubular string; and the second method further includes locking the slip cartridge in the wellhead by effecting relative movement of the tubular string, the locking collar, and a locking sleeve of the slip cartridge together relative to one or more body portions of the slip cartridge. In one or more embodiments, the second method further includes detaching and removing the locking collar from the slip cartridge by effecting relative movement of the tubular string and the locking collar together relative to the one or more body portions and the locking sleeve. In one or more embodiments, the second method further includes, after setting the slip cartridge in the wellhead, unlocking the slip cartridge from the wellhead by effecting movement of the locking sleeve relative to the one or more body portions. In one or more embodiments, the second method further includes, after setting the slip cartridge in the wellhead, leaving behind a remainder of the slip cartridge, including at least the plurality of slips and a slip bowl of the slip cartridge, by detaching and removing one or more body portions of the slip cartridge from the slip bowl, wherein the slip bowl supports the plurality of slips secured to the second segment of the tubular string. In one or more embodiments, the second method further includes, after setting the slip cartridge in the wellhead, leaving behind a remainder of the slip cartridge, including at least the plurality of slips and a slip bowl of the slip cartridge, by detaching and removing a setting ring of the slip cartridge from the plurality of slips, wherein securing the plurality of slips of the slip cartridge to the second segment of the tubular string includes effecting relative movement of the setting ring and the plurality of slips together relative to the slip bowl; and wherein the slip bowl supports the plurality of slips secured to the second segment of the tubular string. In one or more embodiments, landing the slip cartridge in the wellhead further includes conveying the slip cartridge installed on the tubular string through a blowout preventer ("BOP") mounted atop the wellhead.

A second apparatus has also been disclosed, according to one or more embodiments of the present disclosure. The second apparatus generally includes: a running collar; and a slip cartridge, wherein the slip cartridge is detachably coupled to the running collar; wherein the slip cartridge includes a plurality of slips; and wherein the slip cartridge is adapted to be: installed on a tubular string by securing the running collar to a first segment of the tubular string; landed in a wellhead by conveying the tubular string on which the slip cartridge is installed through the wellhead and into a wellbore; left behind landed in the wellhead by detaching and removing the running collar from the slip cartridge; and set by securing the plurality of slips to a second segment of the tubular string. In one or more embodiments, the second apparatus further includes the tubular string, wherein, when the slip cartridge is set, a remainder of the tubular string extending from the wellhead into the wellbore is adapted to be left behind by cutting off and removing a portion of the tubular string above the second segment. In one or more embodiments, the slip cartridge further includes one or more body portions and a slip bowl; and, when the slip cartridge is set: the slip bowl supports the plurality of slips; and a remainder of the slip cartridge, including at least the plurality of slips and the slip bowl, is adapted to be left behind set in the wellhead by detaching and removing the one or more body portions from the slip bowl. In one or more embodiments, the slip cartridge further includes a setting ring and a slip bowl; the setting ring is adapted to set the slip cartridge by effecting relative movement of the plurality of slips relative to the slip bowl to secure the plurality of slips to the second segment of the tubular string; and, when the slip cartridge is set: the slip bowl supports the plurality of slips; and a remainder of the slip cartridge, including at least the plurality of slips and the slip bowl, is adapted to be left behind set in the wellhead by detaching and removing the setting ring from the plurality of slips. In one or more embodiments, the second apparatus further includes a locking collar, wherein the slip cartridge further includes one or more body portions and a locking sleeve via which the slip cartridge is detachably coupled to the locking collar; and wherein the slip cartridge is further adapted to be: installed on the tubular string by securing the locking collar to a third segment of the tubular string; and locked in the wellhead by effecting movement of the tubular string, the locking collar, and the locking sleeve together relative to the one or more body portions. In one or more embodiments, the locking collar is adapted to be detached and removed from the slip cartridge by effecting relative movement of the tubular string and the locking collar together relative to the one or more body portions and the locking sleeve. In one or more embodiments, when the slip cartridge is set, the slip cartridge is further adapted to be unlocked from the wellhead by effecting movement of the locking sleeve relative to the one or more body portions. In one or more embodiments, the slip cartridge further includes one or more body portions and a slip bowl; and, when the slip cartridge is set: the slip bowl supports the plurality of slips; and a remainder of the slip cartridge, including at least the plurality of slips and the slip bowl, is adapted to be left behind set in the wellhead by detaching and removing the one or more body portions from the slip bowl. In one or more embodiments, the slip cartridge further includes a setting ring and a slip bowl; the setting ring is adapted to set the slip cartridge by effecting relative movement of the plurality of slips relative to the slip bowl to secure the plurality of slips to the second segment of the tubular string; and, when the slip cartridge is set: the slip bowl supports the plurality of slips; and a remainder of the slip cartridge, including at least the plurality of slips and the slip bowl, is adapted to be left behind set in the wellhead by detaching and removing the setting ring from the plurality of slips. In one or more embodiments, the slip cartridge is further adapted to be landed in the wellhead by conveying the slip cartridge installed on the tubular string through a blowout preventer ("BOP") mounted atop the wellhead.

A third method has been disclosed, according to one or more embodiments of the present disclosure. The third method generally includes: securing a slip cartridge to a first segment of a tubular string; landing the slip cartridge in a wellhead by conveying the tubular string to which the slip cartridge is secured through the wellhead and into a wellbore; leaving behind the slip cartridge landed in the wellhead; and setting the slip cartridge in the wellhead by securing a plurality of slips of the slip cartridge to a second segment of the tubular string. In one or more embodiments, the third method further includes, after setting the slip cartridge in the wellhead, leaving behind a remainder of the tubular string extending from the wellhead into the wellbore by cutting off and removing a portion of the tubular string above the second segment. In one or more embodiments, the third method further includes, after setting the slip cartridge in the wellhead, leaving behind a remainder of the slip cartridge, including at least the plurality of slips and a slip bowl of the slip cartridge, by detaching and removing one or more body portions of the slip cartridge from the slip bowl, wherein the slip bowl supports the plurality of slips secured to the second segment of the tubular string. In one or more embodiments, the third method further includes, after setting the slip cartridge in the wellhead, leaving behind a remainder of the slip cartridge, including at least the plurality of slips and a slip bowl of the slip cartridge, by detaching and removing a setting ring of the slip cartridge from the plurality of slips, wherein securing the plurality of slips of the slip cartridge to the second segment of the tubular string includes effecting relative movement of the setting ring and the plurality of slips together relative to the slip bowl; and wherein the slip bowl supports the plurality of slips secured to the second segment of the tubular string. In one or more embodiments, the third method further includes: securing the slip cartridge to a third segment of the tubular string via a locking collar; and locking the slip cartridge in the wellhead by effecting relative movement of the tubular string, the locking collar, and a locking sleeve of the slip cartridge together relative to one or more body portions of the slip cartridge, wherein the slip cartridge is detachably coupled to the locking collar via the locking sleeve. In one or more embodiments, the third method further includes detaching and removing the locking collar from the slip cartridge by effecting relative movement of the tubular string and the locking collar together relative to the one or more body portions and the locking sleeve. In one or more embodiments, the third method further includes, after setting the slip cartridge in the wellhead, unlocking the slip cartridge from the wellhead by effecting movement of the locking sleeve relative to the one or more body portions. In one or more embodiments, the third method further including, after setting the slip cartridge in the wellhead, leaving behind a remainder of the slip cartridge, including at least the plurality of slips and a slip bowl of the slip cartridge, by detaching and removing one or more body portions of the slip cartridge from the slip bowl, wherein the slip bowl supports the plurality of slips secured to the second segment of the tubular string. In one or more embodiments, the third method further includes, after setting the slip cartridge in the wellhead, leaving behind a remainder of the slip cartridge, including at least the plurality of slips and a slip bowl of the slip cartridge, by detaching and removing a setting ring of the slip cartridge from the plurality of slips, wherein securing the plurality of slips of the slip cartridge to the second segment of the tubular string includes effecting relative movement of the setting ring and the plurality of slips together relative to the slip bowl; and wherein the slip bowl supports the plurality of slips secured to the second segment of the tubular string. In one or more embodiments, landing the slip cartridge in the wellhead further includes conveying the slip cartridge installed on the tubular string through a blowout preventer ("BOP") mounted atop the wellhead.

A third apparatus has also been disclosed, according to one or more embodiments of the present disclosure. The third apparatus generally includes a slip cartridge, wherein the slip cartridge includes a plurality of slips; and wherein the slip cartridge is adapted to be: secured to a first segment of a tubular string; landed in a wellhead by conveying the tubular string to which the slip cartridge is secured through the wellhead and into a wellbore; left behind landed in the wellhead; and set by securing the plurality of slips to a second segment of the tubular string. In one or more embodiments, the third apparatus further includes the tubular string, wherein, when the slip cartridge is set, a remainder of the tubular string extending from the wellhead into the wellbore is adapted to be left behind by cutting off and removing a portion of the tubular string above the second segment. In one or more embodiments, the slip cartridge further includes one or more body portions and a slip bowl; and, when the slip cartridge is set: the slip bowl supports the plurality of slips; and a remainder of the slip cartridge, including at least the plurality of slips and the slip bowl, is adapted to be left behind set in the wellhead by detaching and removing the one or more body portions from the slip bowl. In one or more embodiments, the slip cartridge further includes a setting ring and a slip bowl; wherein the setting ring is adapted to set the slip cartridge by effecting relative movement of the plurality of slips relative to the slip bowl to secure the plurality of slips to the second segment of the tubular string; and wherein, when the slip cartridge is set: the slip bowl supports the plurality of slips; and a remainder of the slip cartridge, including at least the plurality of slips and the slip bowl, is adapted to be left behind set in the wellhead by detaching and removing the setting ring from the plurality of slips. In one or more embodiments, the third apparatus further includes a locking collar, wherein the slip cartridge further includes one or more body portions and a locking sleeve via which the slip cartridge is detachably coupled to the locking collar; and wherein the slip cartridge is further adapted to be: secured to a third segment of the tubular string via the locking collar; and locked in the wellhead by effecting movement of the tubular string, the locking collar, and the locking sleeve together relative to the one or more body portions. In one or more embodiments, the locking collar is adapted to be detached and removed from the slip cartridge by effecting relative movement of the tubular string and the locking collar together relative to the one or more body portions and the locking sleeve. In one or more embodiments, when the slip cartridge is set, the slip cartridge is further adapted to be unlocked from the wellhead by effecting movement of the locking sleeve relative to the one or more body portions. In one or more embodiments, the slip cartridge further includes one or more body portions and a slip bowl; and, when the slip cartridge is set: the slip bowl supports the plurality of slips; and a remainder of the slip cartridge, including at least the plurality of slips and the slip bowl, is adapted to be left behind set in the wellhead by detaching and removing the one or more body portions from the slip bowl. In one or more embodiments, the slip cartridge further includes a setting ring and a slip bowl; the setting ring is adapted to set the slip cartridge by effecting relative movement of the plurality of slips relative to the slip bowl to secure the plurality of slips to the second segment of the tubular string; and, when the slip cartridge is set: the slip bowl supports the plurality of slips; and a remainder of the slip cartridge, including at least the plurality of slips and the slip bowl, is adapted to be left behind set in the wellhead by detaching and removing the setting ring from the plurality of slips. In one or more embodiments, the slip cartridge is further adapted to be landed in the wellhead by conveying the slip cartridge installed on the tubular string through a blowout preventer ("BOP") mounted atop the wellhead.

It is understood that variations may be made in the foregoing without departing from the scope of the disclosure.

In one or more embodiments, the elements and teachings of the various embodiments disclosed herein may be combined in whole or in part in some or all of said embodiment(s). In addition, one or more of the elements and teachings of the various embodiments disclosed herein may be omitted, at least in part, or combined, at least in part, with one or more of the other elements and teachings of said embodiment(s).

Any spatial references such as, for example, "upper," "lower," "above," "below," "between," "bottom," "vertical," "horizontal," "angular," "upwards," "downwards," "side-to-side," "left-to-right," "left," "right," "right-to-left," "top-to-bottom," "bottom-to-top," "top," "bottom," "bottom-up," "top-down," etc., are for the purpose of illustration only and do not limit the specific orientation or location of the structure described above.

In one or more embodiments, while different steps, processes, and procedures are described as appearing as distinct acts, one or more of the steps, one or more of the processes, or one or more of the procedures may also be performed in different orders, simultaneously or sequentially. In one or more embodiments, the steps, processes or procedures may be merged into one or more steps, processes or procedures. In one or more embodiments, one or more of the operational steps in each embodiment may be omitted. Moreover, in some instances, some features of the present disclosure may be employed without a corresponding use of the other features. Moreover, one or more of the embodiments disclosed above and in the '310 Patent and the '255 Application, or variations thereof, may be combined in whole or in part with any one or more of the other embodiments described above and the '310 Patent and the '255 Application, or variations thereof.

Although various embodiments have been disclosed in detail above and in the '310 Patent and the '255 Application, the embodiments disclosed are exemplary only and are not limiting, and those skilled in the art will readily appreciate that many other modifications, changes, and substitutions are possible in the embodiments without materially departing from the novel teachings and advantages of the present disclosure. Accordingly, all such modifications, changes, and substitutions are intended to be included within the scope of this disclosure as defined in the following claims. In the claims, means-plus-function clauses are intended to cover the structures described herein as performing the recited function and not only structural equivalents, but also equivalent structures. Moreover, it is the express intention of the applicant not to invoke 35 U.S.C. § 112 (f) for any limitations of any of the claims herein, except for those in which the claim expressly uses the word "means" together with an associated function.

What is claimed is:

1. A method, comprising:

installing a slip cartridge on a tubular string by securing a running collar to which the slip cartridge is detachably coupled to a first segment of the tubular string;

landing the slip cartridge in a wellhead by conveying the tubular string on which the slip cartridge is installed through the wellhead and into a wellbore;

leaving behind the slip cartridge landed in the wellhead by detaching and removing the running collar from the slip cartridge;

setting the slip cartridge in the wellhead by securing a plurality of slips of the slip cartridge to a second segment of the tubular string; and after setting the slip cartridge in the wellhead:

leaving behind a remainder of the tubular string extending from the wellhead into the wellbore by cutting off and removing a portion of the tubular string above the second segment;

leaving behind a remainder of the slip cartridge, including at least the plurality of slips and a slip bowl of the slip cartridge, by:

detaching and removing one or more body portions of the slip cartridge from the slip bowl, wherein the slip bowl supports the plurality of slips secured to the second segment of the tubular string; and detaching and removing a setting ring of the slip cartridge from the plurality of slips, wherein securing the plurality of slips of the slip cartridge to the second segment of the tubular string comprises effecting relative movement of the setting ring and the plurality of slips together relative to the slip bowl;

wherein installing the slip cartridge on the tubular string further comprises securing a locking collar to which the slip cartridge is detachably coupled to a third segment of the tubular string; and wherein the method further comprises locking the slip cartridge in the wellhead by effecting relative movement of the tubular string, the locking collar, and a locking sleeve of the slip cartridge together relative to one or more body portions of the slip cartridge.

2. The method of claim 1, further comprising:

detaching and removing the locking collar from the slip cartridge by effecting relative movement of the tubular string and the locking collar together relative to the one or more body portions and the locking sleeve.

3. The method of claim 2, further comprising:

after setting the slip cartridge in the wellhead, unlocking the slip cartridge from the wellhead by effecting movement of the locking sleeve relative to the one or more body portions.

4. The method of claim 2, wherein landing the slip cartridge in the wellhead further comprises conveying the slip cartridge installed on the tubular string through a blowout preventer ("BOP") mounted atop the wellhead.

5. An apparatus. comprising:

a tubular string;

a running collar;

a slip cartridge; and a locking collar, wherein the slip cartridge is detachably coupled to the running collar;

wherein the slip cartridge comprises a setting ring, a plurality of slips, a slip bowl, and one or more body portions;

wherein the slip cartridge is adapted to be:

installed on the tubular string by securing the running collar to a first segment of the tubular string;

landed in a wellhead by conveying the tubular string on which the slip cartridge is installed through the wellhead and into a wellbore;

left behind landed in the wellhead by detaching and removing the running collar from the slip cartridge; and set by securing the plurality of slips to a second segment of the tubular string;

wherein the setting ring is adapted to set the slip cartridge by effecting relative movement of the plurality of slips relative to the slip bowl to secure the plurality of slips to the second segment of the tubular string;

wherein, when the slip cartridge is set:

a remainder of the tubular string extending from the wellhead into the wellbore is adapted to be left behind by cutting off and removing a portion of the tubular string above the second segment;

the slip bowl supports the plurality of slips;

a remainder of the slip cartridge, including at least the plurality of slips and the slip bowl, is adapted to be left behind set in the wellhead by:

detaching and removing the one or more body portions from the slip bowl; and detaching and removing the setting ring from the plurality of slips;

wherein the slip cartridge further comprises one or more body portions and a locking sleeve via which the slip cartridge is detachably coupled to the locking collar; and wherein the slip cartridge is further adapted to be:

installed on the tubular string by securing the locking collar to a third segment of the tubular string; and locked in the wellhead by effecting movement of the tubular string, the locking collar, and the locking sleeve together relative to the one or more body portions.

6. The apparatus of claim 5, wherein the locking collar is adapted to be detached and removed from the slip cartridge by effecting relative movement of the tubular string and the locking collar together relative to the one or more body portions and the locking sleeve.

7. The apparatus of claim 6, wherein, when the slip cartridge is set, the slip cartridge is further adapted to be unlocked from the wellhead by effecting movement of the locking sleeve relative to the one or more body portions.

8. The apparatus of claim 7, wherein the slip cartridge is further adapted to be landed in the wellhead by conveying the slip cartridge installed on the tubular string through a blowout preventer ("BOP") mounted atop the wellhead.

9. A method, comprising:

securing a slip cartridge to a first segment of a tubular string;

landing the slip cartridge secured to the first segment of the tubular string in a wellhead by conveying a portion of the tubular string through the wellhead and into a wellbore;

leaving behind the slip cartridge landed in the wellhead by:

detaching the first segment of the tubular string from the slip cartridge landed in the wellhead; and conveying another portion of the tubular string, including the first segment of the tubular string detached from the slip cartridge landed in the wellhead, into the wellbore; and setting the slip cartridge left behind landed in the wellhead by securing a plurality of slips of the slip cartridge to a second segment of the tubular string.

10. The method of claim 9, further comprising:

after setting the slip cartridge in the wellhead, leaving behind a remainder of the tubular string extending from the wellhead into the wellbore by cutting off and removing a portion of the tubular string above the second segment.

11. The method of claim 9, further comprising:

after setting the slip cartridge in the wellhead, leaving behind a remainder of the slip cartridge, including at least the plurality of slips and a slip bowl of the slip cartridge, by detaching and removing one or more body portions of the slip cartridge from the slip bowl, wherein the slip bowl supports the plurality of slips secured to the second segment of the tubular string.

12. The method of claim 9, further comprising:

after setting the slip cartridge in the wellhead, leaving behind a remainder of the slip cartridge, including at least the plurality of slips and a slip bowl of the slip cartridge, by detaching and removing a setting ring of the slip cartridge from the plurality of slips, wherein securing the plurality of slips of the slip cartridge to the second segment of the tubular string comprises effecting relative movement of the setting ring and the plurality of slips together relative to the slip bowl; and wherein the slip bowl supports the plurality of slips secured to the second segment of the tubular string.

13. The method of claim 9, further comprising:

securing the slip cartridge to a third segment of the tubular string via a locking collar; and locking the slip cartridge in the wellhead by effecting relative movement of the tubular string, the locking collar, and a locking sleeve of the slip cartridge together relative to one or more body portions of the slip cartridge, wherein the slip cartridge is detachably coupled to the locking collar via the locking sleeve.

14. The method of claim 13, further comprising:

detaching and removing the locking collar from the slip cartridge by effecting relative movement of the tubular string and the locking collar together relative to the one or more body portions and the locking sleeve.

15. The method of claim 14, further comprising:

after setting the slip cartridge in the wellhead, unlocking the slip cartridge from the wellhead by effecting movement of the locking sleeve relative to the one or more body portions.

16. The method of claim 15, further comprising:

after setting the slip cartridge in the wellhead, leaving behind a remainder of the slip cartridge, including at least the plurality of slips and a slip bowl of the slip cartridge, by detaching and removing one or more body portions of the slip cartridge from the slip bowl, wherein the slip bowl supports the plurality of slips secured to the second segment of the tubular string.

17. The method of claim 15, further comprising:

after setting the slip cartridge in the wellhead, leaving behind a remainder of the slip cartridge, including at least the plurality of slips and a slip bowl of the slip cartridge, by detaching and removing a setting ring of the slip cartridge from the plurality of slips, wherein securing the plurality of slips of the slip cartridge to the second segment of the tubular string comprises effecting relative movement of the setting ring and the plurality of slips together relative to the slip bowl; and wherein the slip bowl supports the plurality of slips secured to the second segment of the tubular string.

18. The method of claim 9, wherein landing the slip cartridge in the wellhead further comprises conveying the slip cartridge installed on the tubular string through a blowout preventer ("BOP") mounted atop the wellhead.

19. An apparatus, comprising:

a slip cartridge, wherein the slip cartridge comprises a plurality of slips; and wherein the slip cartridge is adapted to be:

secured to a first segment of a tubular string;

while secured to the first segment of the tubular string, landed in a wellhead by conveying a portion of the tubular string through the wellhead and into a wellbore;

left behind landed in the wellhead by:

detaching the first segment of the tubular string from the slip cartridge landed in the wellhead; and conveying another portion of the tubular string, including the first segment of the tubular string detached from the slip cartridge landed in the wellhead, into the wellbore; and while left behind landed in the wellhead, set by securing the plurality of slips to a second segment of the tubular string.

20. The apparatus of claim 19, further comprising:

the tubular string, wherein, when the slip cartridge is set, a remainder of the tubular string extending from the wellhead into the wellbore is adapted to be left behind by cutting off and removing a portion of the tubular string above the second segment.

21. The apparatus of claim 19, wherein the slip cartridge further comprises one or more body portions and a slip bowl; and wherein, when the slip cartridge is set:

the slip bowl supports the plurality of slips; and a remainder of the slip cartridge, including at least the plurality of slips and the slip bowl, is adapted to be left behind set in the wellhead by detaching and removing the one or more body portions from the slip bowl.

22. The apparatus of claim 19, wherein the slip cartridge further comprises a setting ring and a slip bowl;

wherein the setting ring is adapted to set the slip cartridge by effecting relative movement of the plurality of slips relative to the slip bowl to secure the plurality of slips to the second segment of the tubular string; and wherein, when the slip cartridge is set:

the slip bowl supports the plurality of slips; and a remainder of the slip cartridge, including at least the plurality of slips and the slip bowl, is adapted to be left behind set in the wellhead by detaching and removing the setting ring from the plurality of slips.

23. The apparatus of claim 19, further comprising:

a locking collar, wherein the slip cartridge further comprises one or more body portions and a locking sleeve via which the slip cartridge is detachably coupled to the locking collar; and wherein the slip cartridge is further adapted to be:

secured to a third segment of the tubular string via the locking collar; and locked in the wellhead by effecting movement of the tubular string, the locking collar, and the locking sleeve together relative to the one or more body portions.

24. The apparatus of claim 23, wherein the locking collar is adapted to be detached and removed from the slip cartridge by effecting relative movement of the tubular string and the locking collar together relative to the one or more body portions and the locking sleeve.

25. The apparatus of claim 24, wherein, when the slip cartridge is set, the slip cartridge is further adapted to be unlocked from the wellhead by effecting movement of the locking sleeve relative to the one or more body portions.

26. The apparatus of claim 25, wherein the slip cartridge further comprises one or more body portions and a slip bowl; and wherein, when the slip cartridge is set:

the slip bowl supports the plurality of slips; and a remainder of the slip cartridge, including at least the plurality of slips and the slip bowl, is adapted to be left behind set in the wellhead by detaching and removing the one or more body portions from the slip bowl.

27. The apparatus of claim 25, wherein the slip cartridge further comprises a setting ring and a slip bowl;

wherein the setting ring is adapted to set the slip cartridge by effecting relative movement of the plurality of slips relative to the slip bowl to secure the plurality of slips to the second segment of the tubular string; and wherein, when the slip cartridge is set:

the slip bowl supports the plurality of slips; and a remainder of the slip cartridge, including at least the plurality of slips and the slip bowl, is adapted to be left behind set in the wellhead by detaching and removing the setting ring from the plurality of slips.

28. The apparatus of claim 19, wherein the slip cartridge is further adapted to be landed in the wellhead by conveying the slip cartridge installed on the tubular string through a blowout preventer ("BOP") mounted atop the wellhead.

* * * * *